US009890910B2

(12) United States Patent
Yamamura

(10) Patent No.: US 9,890,910 B2
(45) Date of Patent: Feb. 13, 2018

(54) OPTICAL UNIT

(71) Applicant: KOITO MANUFACTURING CO., LTD., Minato-ku (JP)

(72) Inventor: Satoshi Yamamura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 178 days.

(21) Appl. No.: 14/057,129

(22) Filed: Oct. 18, 2013

(65) Prior Publication Data

US 2014/0043805 A1 Feb. 13, 2014

Related U.S. Application Data

(63) Continuation of application No. PCT/JP2012/002359, filed on Apr. 4, 2012.

(30) Foreign Application Priority Data

Apr. 22, 2011 (JP) ..... 2011-096254

(51) Int. Cl.
*F21V 9/00* (2015.01)
*F21K 99/00* (2016.01)
(Continued)

(52) U.S. Cl.
CPC ..... *F21K 9/56* (2013.01); *F21S 10/023* (2013.01); *F21S 10/026* (2013.01);
(Continued)

(58) Field of Classification Search
CPC .... F21S 10/023; F21S 10/026; F21S 48/1131; F21S 48/1159; F21S 48/1323;
(Continued)

(56) References Cited

U.S. PATENT DOCUMENTS 4,868,721 A * 9/1989 Soardo ..... F21S 48/1136 362/282
5,610,647 A * 3/1997 Takada ..... B41J 2/473 347/137
(Continued)

FOREIGN PATENT DOCUMENTS

CN 100351673 C 11/2007
DE 10 2008 022 795 A1 11/2009
(Continued)

OTHER PUBLICATIONS

Yamanaka, Illumintion device and image projecting device, Dec. 3, 2003, JP2003344948A, English translation.*
(Continued)

*Primary Examiner* — Bryon T Gyllstrom
*Assistant Examiner* — James Endo

(57) ABSTRACT

An optical unit includes a light source having both a first light emitting element for emitting light having a first color and a second light emitting element for emitting light having a second color that is different from the first color; and a rotating reflector configured to be rotated in one direction around a rotational shaft, while reflecting the light having the first color and the light having the second color, which have been emitted from the light source. In the rotating reflector, a reflecting surface is provided such that a predetermined light distribution pattern is formed with the light having the first color and the light having the second color, which have been reflected by the rotation of the rotating reflector, being superimposed one on another.

10 Claims, 27 Drawing Sheets

(51) Int. Cl.

| | |
|---|---|
| ***F21S 10/02*** | (2006.01) |
| *F21S 8/10* | (2006.01) |
| *F21V 14/04* | (2006.01) |
| *F21V 13/06* | (2006.01) |
| *F21W 131/406* | (2006.01) |
| *F21Y 115/10* | (2016.01) |
| *F21Y 113/13* | (2016.01) |

(52) U.S. Cl.
CPC ..... *F21S 48/1131* (2013.01); *F21S 48/1159* (2013.01); *F21S 48/137* (2013.01); *F21S 48/1323* (2013.01); *F21S 48/1747* (2013.01); *F21S 48/1757* (2013.01); *F21S 48/1752* (2013.01); *F21V 13/06* (2013.01); *F21V 14/04* (2013.01); *F21W 2131/406* (2013.01); *F21Y 2113/13* (2016.08); *F21Y 2115/10* (2016.08)

(58) Field of Classification Search
CPC .. F21S 48/137; F21S 48/1752; F21S 48/1757; F21S 48/1747; F21S 10/06; F21S 10/063; F21S 10/066; F21S 48/1789; F21S 48/1773; F21S 10/007; F21V 13/06; F21V 14/04; F21K 9/58
USPC ..... 362/35, 512–514, 516–518
See application file for complete search history.

(56) References Cited

U.S. PATENT DOCUMENTS

| | | | | | |
|---|---|---|---|---|---|
| 5,874,929 | A * | 2/1999 | Opower | B41J 2/473 | 345/32 |
| 5,961,201 | A * | 10/1999 | Gismondi | F21S 10/02 | 362/1 |
| 6,020,937 | A * | 2/2000 | Bardmesser | G02B 5/09 | 250/236 |
| 6,351,324 | B1 * | 2/2002 | Flint | H04N 9/3129 | 348/210.99 |
| 6,352,357 | B1 * | 3/2002 | Woolard | F21S 10/06 | 362/277 |
| 6,523,977 | B2 * | 2/2003 | Chuang | G02B 6/0006 | 362/231 |
| 6,705,745 | B1 * | 3/2004 | Pederson | B60Q 1/2611 | 362/284 |
| 6,788,445 | B2 * | 9/2004 | Goldberg | B41J 2/473 | 347/250 |
| 7,360,928 | B2 * | 4/2008 | Moon | G02B 26/0833 | 353/99 |
| 2001/0019486 | A1 * | 9/2001 | Thominet | F21S 48/1131 | 362/543 |
| 2002/0114161 | A1 * | 8/2002 | Barnett | B60Q 1/2611 | 362/282 |
| 2008/0094851 | A1 * | 4/2008 | Engl | F21S 48/1154 | 362/514 |
| 2009/0015388 | A1 | 1/2009 | Yagi et al. | | |
| 2009/0046474 | A1 | 2/2009 | Sato et al. | | |
| 2010/0033946 | A1 * | 2/2010 | Chaves | F21S 10/06 | 362/35 |

FOREIGN PATENT DOCUMENTS

| | | | | |
|---|---|---|---|---|
| DE | 10 2009 025 678 | A1 | 1/2010 | |
| EP | 1 193 531 | A1 | 4/2002 | |
| EP | 1 347 653 | A2 | 9/2003 | |
| JP | 10-144108 | A | 5/1998 | |
| JP | 2003-095012 | A | 4/2003 | |
| JP | 2003-344948 | A | 12/2003 | |
| JP | 2004-071393 | A | 3/2004 | |
| JP | 2006-330176 | A | 12/2006 | |
| JP | 2008-102304 | A | 5/2008 | |
| JP | 2008-539537 | A | 11/2008 | |
| JP | 2009-018726 | A | 1/2009 | |
| JP | 2009-224039 | A | 10/2009 | |
| JP | 2010-036835 | A | 2/2010 | |
| WO | 2006/116960 | A1 | 11/2006 | |
| WO | WO 2008148362 | A2 * | 12/2008 | F21S 10/007 |

OTHER PUBLICATIONS

Chinese Office Action dated Jan. 12, 2015 issued in corresponding Chinese Patent Appln. No. 201280019716.5, with English translation (16 pages).

The extended European Search Report issued on Oct. 10, 2014, by the European Patent Office in corresponding European Patent Application No. 12774115.5-1756. (7 pages).

Office Action (Notification of Reason(s) for Refusal) dated Nov. 18, 2014, by the Japan Patent Office in corresponding Japanese Patent Application No. 2011-096254, and an English Translation of the Office Action. (7 pages).

Notification Concerning Transmittal of International Preliminary Report of Patentability (Forms PCT/IB/326 and PCT/IB/373) and the Written Opinion of the International Searching Authority (Form PCT/ISA/237 dated Oct. 22, 2013, by the International Bureau of WIPO in corresponding International Application No. PCT/JP2012/002359. (10 pages).

International Search Report dated Jul. 17, 2012 by the Japanese Patent Office, in corresponding International Application No. PCT/JP2012/002359.( 4 pages).

* cited by examiner

| PLANE MIRROR ASPHERIC LENS |
|---|
|  |
| WIDTH (H LINE) × HEIGHT (V LINE) OF IMAGE 2.3° × 6.3° |
| MAXIMUM LIGHT INTENSITY 160,000cd |

| BLADE MIRROR ASPHERIC LENS |
|---|
|  |
| 5.0° × 7.4° |
| 100,000 cd |

| BLADE MIRROR FREE-FORM SURFACE LENS |
|---|
|  |
| 2.8° × 6.8° |
| 146,000 cd |

OPTICAL UNIT

CROSS-REFERENCE TO RELATED APPLICATIONS

This application is based upon and claims the benefit of priority from the prior Japanese Patent Application No. 2011-096254, filed on Apr. 22, 2011, and International Patent Application No. PCT/JP 2012/002359, filed on Apr. 4, 2012, the entire content of each of which is incorporated herein by reference.

BACKGROUND OF THE INVENTION

1. Field of the Invention

The present invention relates to an optical unit, and in particular, to an optical unit to be used in an automotive lamp.

2. Description of the Related Art

Until now, halogen lamps and HID (High Intensity Discharge) lamps are adopted as the white light sources of automotive lamps. In addition, automotive lamps, in each of which an LED is adopted as a light source, have been developed in recent years. When a white light source is achieved by using an LED, a blue LED and a yellow phosphor are generally combined together. In addition, it is known that lighting lamps, in each of which white light is achieved by combining together LEDs having emitted light colors different from each other, have been devised.

SUMMARY OF THE INVENTION

However, when white light is achieved by combining an LED and a phosphor, part of the emitted light from the LED is absorbed into the phosphor, and hence the efficiency in using the light emitted by the LED is decreased. Accordingly, a further improvement is required for an increase in luminance. On the other hand, when white light is achieved with a lot of LEDs, having emitted light colors different from each other, being aligned, the color or brightness is likely to be uneven within an irradiation range.

The present invention has been made in view of these situations, and a purpose of the invention is to provide a technique in which a light distribution pattern having a desired color can be achieved.

In order to solve the aforementioned problem, an optical unit according to an aspect of the present invention comprises: a light source including both a first light emitting element for emitting light having a first color and a second light emitting element for emitting light having a second color that is different from the first color; and a rotating reflector configured to be rotated in one direction around a rotational shaft, while reflecting the light having the first color and the light having the second color, which have been emitted from the light source. In the rotating reflector, a reflecting surface is provided such that a predetermined light distribution pattern is formed with the light having the first color and the light having the second color, which have been reflected by the rotation of the rotating reflector, being superimposed one on another.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
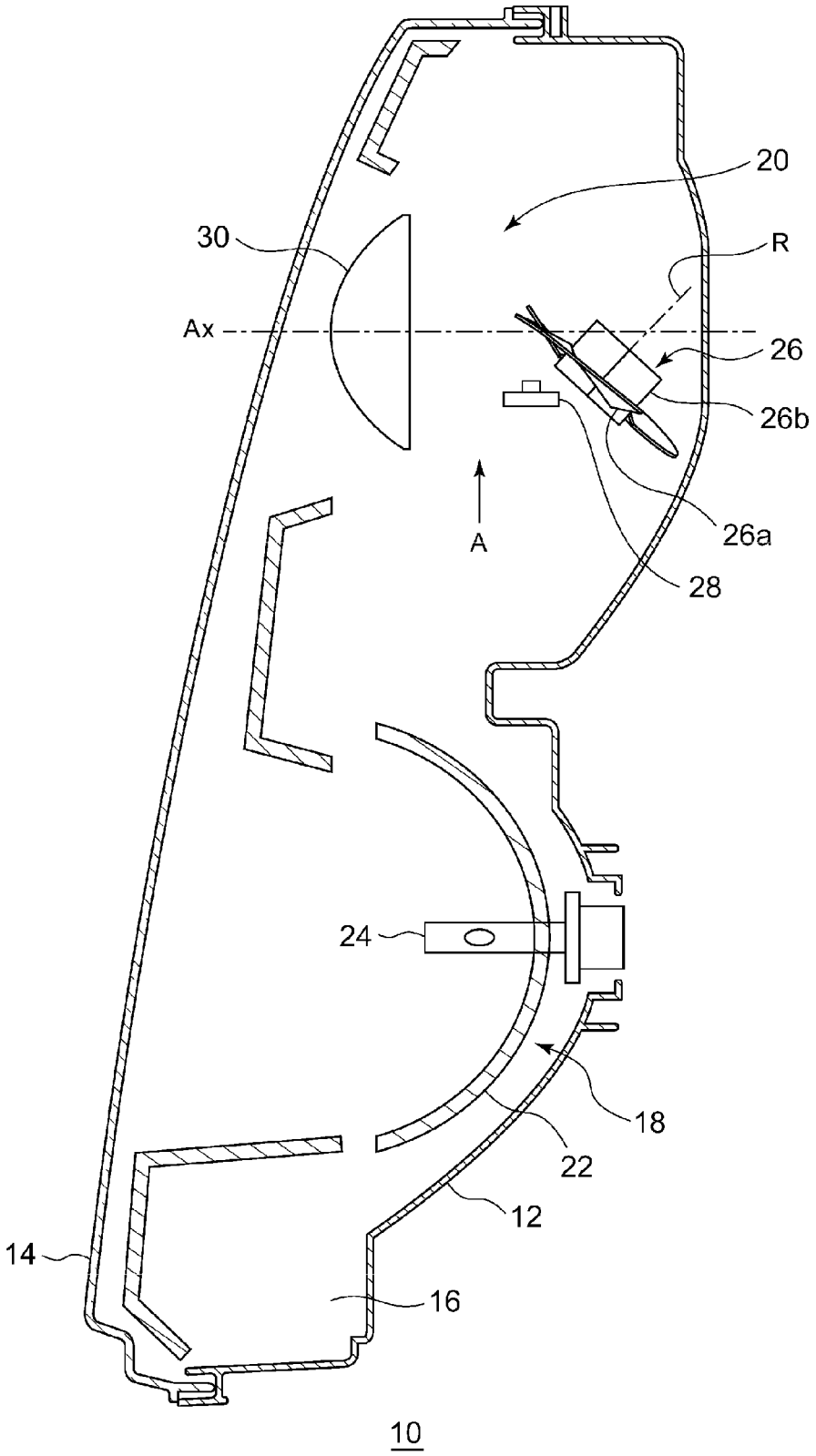
FIG. 1 is a horizontal sectional view of an automotive headlamp according to the present embodiment.

In order to solve the aforementioned problem, an optical unit according to an aspect of the present invention comprises: a light source including both a first light emitting element for emitting light having a first color and a second light emitting element for emitting light having a second color that is different from the first color; and a rotating reflector configured to be rotated in one direction around a rotational shaft, while reflecting the light having the first color and the light having the second color, which have been emitted from the light source. In the rotating reflector, a reflecting surface is provided such that a predetermined light distribution pattern is formed with the light having the first color and the light having the second color, which have been reflected by the rotation of the rotating reflector, being superimposed one on another.

According to this aspect, a predetermined light distribution pattern can be formed by the rotation in one direction of the rotating reflector. Further, a light distribution pattern having a color, which cannot be achieved by one type of light emitting elements alone, can be formed by a plurality of types of light emitting elements having emitted light colors different form each other.

The second light emitting element may emit, as the light having the second color, light having a color that is in a complementary color relationship with the light having the first color. Thereby, a light distribution pattern having white color can be formed by using light emitting elements.

The optical unit may further comprise a current adjusting unit configured to adjust a current flowing through at least one of the first light emitting element and the second light emitting element. Thereby, the color of the light distribution pattern can be changed.

Another aspect of the present invention is also an optical unit. This optical unit comprises: a light source including a first light emitting element for emitting light having a first color, a second light emitting element for emitting light having a second color different from the first color, and a third light emitting element for emitting light having a third color different from the first color and the second color; and a rotating reflector configured to be rotated in one direction around a rotational shaft, while reflecting the light having the first color, the light having the second color, and the light having the third color, which have been emitted from the light source. In the rotating reflector, a reflecting surface is provided such that a predetermined light distribution pattern having white color is formed with the light having the first color, the light having the second color, and the light having the third color, which have been reflected by the rotation of the rotating reflector, being superimposed one on another.

According to this aspect, a predetermined light distribution pattern can be formed by the rotation in one direction of the rotating reflector. Further, a light distribution pattern having white color, which cannot be achieved by one type of light emitting elements alone, can be formed by a plurality of types of light emitting elements having emitted light colors different from each other.

The optical unit may further comprise a current adjusting unit configured to adjust a current flowing through at least one of the first light emitting element, the second light emitting element, and the third light emitting element. Thereby, the color of the light distribution pattern can be changed.

The invention will now be described by reference to the preferred embodiments. This does not intend to limit the scope of the present invention, but to exemplify the invention.

Hereinafter, the present invention will be described based on preferred embodiments and with reference to accompanying drawings. The same or like components, members, or processes illustrated in each view are denoted by the same reference numeral, and duplicative description thereof will be appropriately omitted. The preferred embodiments are illustratively described without limiting the invention, and all of the features and combinations thereof described in the preferred embodiments are not necessarily essential to the invention.

An optical unit according to the present invention can be used in various automotive lamps. Hereinafter, the case where the optical unit according to the invention is applied, of automotive lamps, to an automotive headlamp will be described.

First Embodiment

FIG. 1 is a horizontal sectional view of an automotive headlamp according to the present embodiment. An automotive headlamp 10 is a right side headlamp mounted on the right side of the front end portion of an automobile, and has the same structure as that of a headlamp mounted on the left side, except that the two structures are symmetrical to each other. Accordingly, the right side automotive headlamp 10 will be described in detail hereinafter, and description of the left side automotive headlamp will be omitted.

As illustrated in FIG. 1, the automotive headlamp 10 includes a lamp body 12 having a concave portion that is opened toward the front. The front opening of the lamp body 12 is covered with a transparent front cover 14 to form a lamp chamber 16. The lamp chamber 16 functions as a space in which two lamp units 18 and 20 are housed in a state where they are arranged to be aligned with each other in the vehicle width direction.

Of these lamp units, the lamp unit 20 arranged outside, i.e., arranged on the upper side illustrated in FIG. 1 in the right side automotive headlamp 10, is a lamp unit including a lens and is configured to radiate a variable high-beam. On the other hand, of these lamp units, the lamp unit 18 arranged inside, i.e., arranged on the lower side illustrated in FIG. 1 in the right side automotive headlamp 10, is configured to radiate a low-beam.

The lamp unit 18 for low-beam includes a reflector 22, a light source bulb (incandescent bulb) 24 supported by the reflector 22, and a non-illustrated shade; and the reflector 22 is supported tiltably with respect to the lamp body 12 by non-illustrated known means, for example, by means using aiming screws and nuts.

As illustrated in FIG. 1, the lamp unit 20 includes a rotating reflector 26, an LED 28, and a convex lens 30 as a projection lens arranged ahead of the rotating reflector 26. Alternatively, a semiconductor light emitting element, such as an EL element, LD element, or the like, may be used as a light source, instead of the LED 28. A light source, in which turning on/off can be accurately performed in a short time, is preferred particularly for the control by which part of a light distribution pattern is shielded from light, which will be described later. The shape of the convex lens 30 may be appropriately selected in accordance with a required light distribution pattern or a light distribution characteristic, such as an illuminance distribution, but an aspheric lens or a free-form surface lens is used. In the present embodiment, an aspheric lens is used as the convex lens 30.

The rotating reflector 26 is rotated in one direction around a rotational shaft R by a drive source, such as a non-illustrated motor. The rotating reflector 26 includes a reflecting surface configured to form a desired light distribution pattern by reflecting the light emitted from the LED 28 while being rotated. In the present embodiment, the rotating reflector 26 forms an optical unit.

Figure 2:
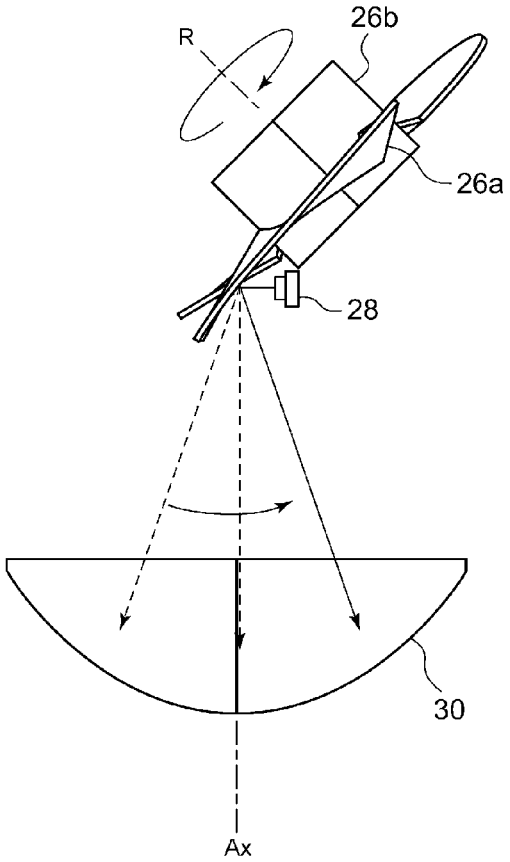
FIG. 2 is a top view schematically illustrating a configuration of a lamp unit including an optical unit according to the present embodiment.
Figure 3:
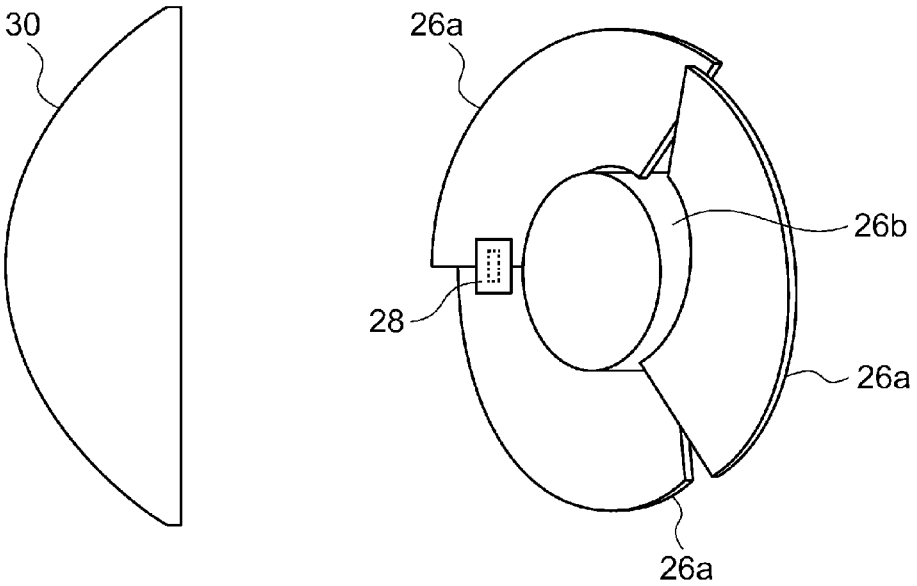
FIG. 3 is a side view in which the lamp unit is viewed from A Direction illustrated in FIG. 1.

FIG. 2 is a top view schematically illustrating the configuration of the lamp unit 20 including the optical unit according to the present embodiment. FIG. 3 is a side view in which the lamp unit 20 is viewed from A Direction illustrated in FIG. 1.

In the rotating reflector 26, three blades 26*a*, each of which functions as a reflecting surface and has the same shape as those of the others, are provided around a tubular rotating part 26*b*. The rotational shaft R of the rotating reflector 26 is inclined with respect to an optical axis Ax and provided in a plane including the optical axis Ax and the LED 28. In other words, the rotational shaft R is provided to be approximately parallel to a scanning plane of the light (irradiation beam) from the LED 28, the light scanning in the horizontal direction by the rotation of the rotating reflector 26. Thereby, the thickness of the optical unit can be made small. The scanning plane used herein can be understood, for example, as a fan-shaped plane formed by continuously connecting the trajectories of the light from the LED 28 that is scanning light. In the lamp unit 20 according to the present embodiment, the size of the LED 28 included therein is relatively small, and the position at which the LED 28 is arranged is present between the rotating reflector 26 and the convex lens 30 and is shifted from the optical axis Ax. Accordingly, the length in the depth direction (the vehicle front-back direction) of the automotive headlamp 10 can be made smaller than that of the case where a light source, a reflector, and a lens are aligned in a line on an optical axis, as in a lamp unit in a conventional projector system.

The shape of each of the blades 26*a* in the rotating reflector 26 is configured such that a secondary light source of the LED 28, generated by being reflected, is formed near to the focal point of the convex lens 30. In addition, each of the blades 26*a* has a twisted shape in which the angle between the optical axis Ax and the reflecting surface is changed moving toward the circumferential direction around the rotational axis R. Thereby, scanning using the light from the LED 28 can be performed, as illustrated in FIG. 2. This point will be further described in detail.

FIGS. 4A to 4E are perspective views illustrating situations of the blades in accordance with rotating angles of the rotating reflector 26 in the lamp unit according to the present embodiment. FIGS. 4F to 4J are views for explaining that a direction, in which the light from the light source is reflected, is changed in accordance with the states of FIGS. 4A to 4E.

Figure 4A:
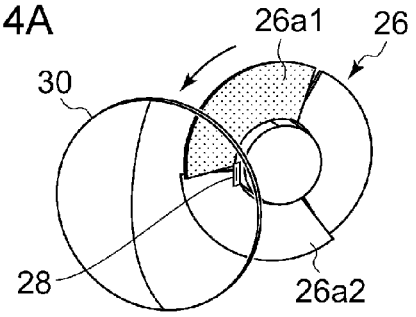
FIGS. 4A to 4J are perspective views illustrating situations of blades in accordance with rotating angles of a rotating reflector in the lamp unit according to the present embodiment.
Figure 4B:
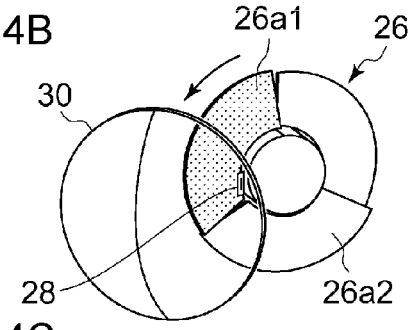

FIG. 4A illustrates a state where the LED 28 is arranged so as to irradiate a boundary region between two blades 26*a*1 and 26*a*2. In this state, the light from the LED 28 is reflected by a reflecting surface S of the blade 26*a*1 and reflected in a direction inclined with respect to the optical axis Ax, as illustrated in FIG. 4F. As a result, of a region in front of a vehicle where a light distribution pattern is formed, one of both the left and right end portions is irradiated. When it is in a state illustrated in FIG. 4B after the rotating reflector 26 is rotated, the reflecting surface S (reflection angle) of the blade 26*a*1 that reflects the light from the LED 28 is changed, because the blade 26*a*1 is twisted. As a result, the light from the LED 28 is reflected in a direction nearer to the optical axis Ax than to the reflection direction illustrated in FIG. 4F, as illustrated in FIG. 4G.

Figure 4C:
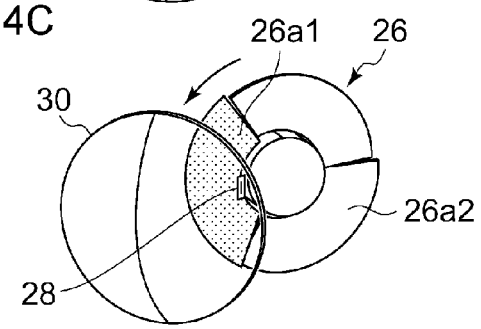
Figure 4D:
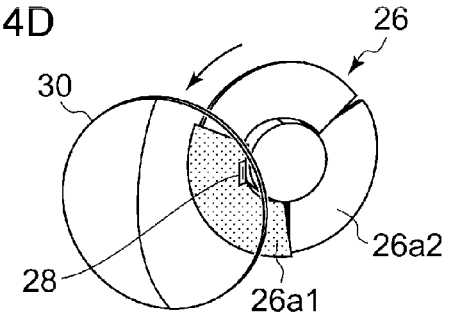
Figure 4E:
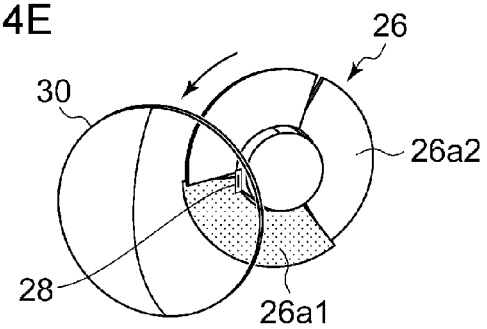
Figure 4F:
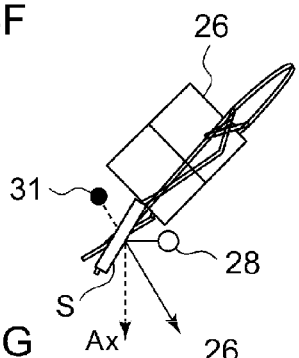
Figure 4G:
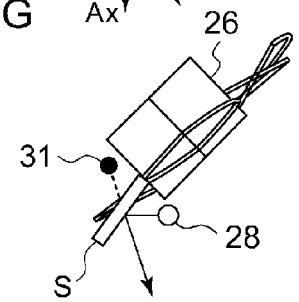
Figure 4H:
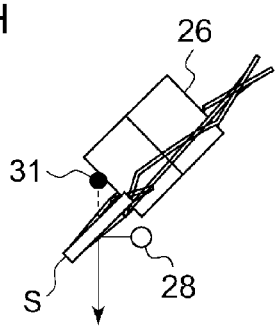
Figure 4I:
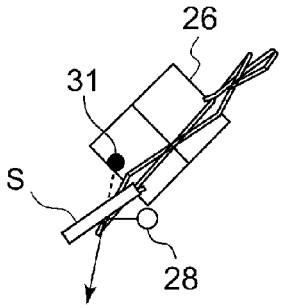
Figure 4J:
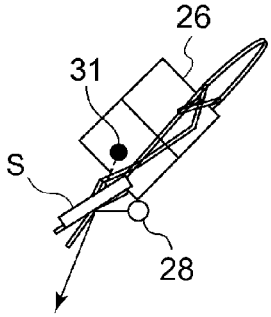
Figure 5A:
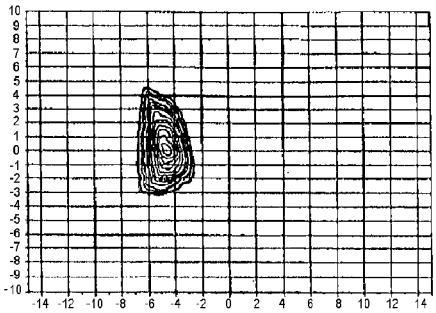
FIGS. 5A to 5E are views illustrating projected images in which the rotating reflector is at scanning positions corresponding to the states of FIGS. 4F to 4J, respectively.
Figure 5B:
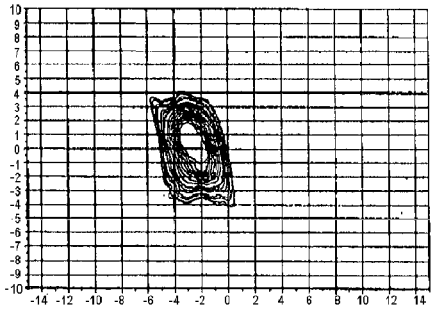
Figure 5C:
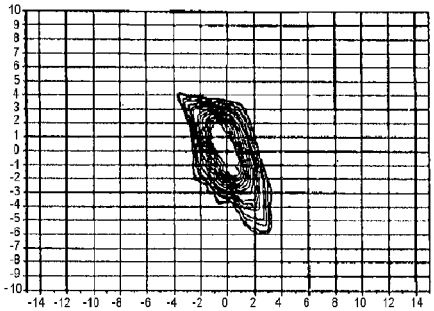
Figure 5D:
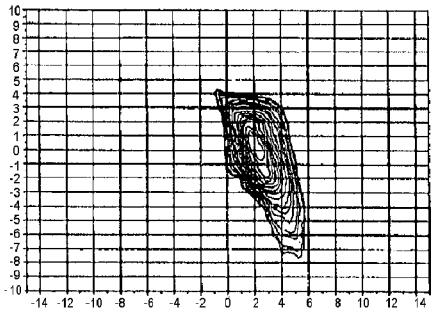
Figure 5E:
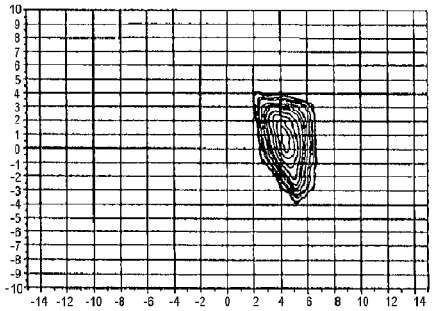

Subsequently, when the rotating reflector 26 is rotated as illustrated in FIGS. 4C, 4D, and 4E, the reflection direction of the light from the LED 28 is changed toward the other end of both the left and right end portions, of the region in front of a vehicle where a light distribution pattern is formed. The rotating reflector 26 according to the present embodiment is configured to be able to scan a forward region in one direction (horizontal direction) and one time with the light from the LED 28, when rotated by 120°. In other words, when one of the blades 26*a* passes in front of the LED 28, a desired region in front of a vehicle is scanned one time by the light from the LED 28. As illustrated in FIGS. 4F to 4J, a secondary light source (light source virtual image) 31 is moved in the horizontal direction near to the focal point of the convex lens 30. The number of the blades 26*a*, the shape thereof, and the rotating speed of the rotating reflector 26 are appropriately set based on the results of experiments or simulations, taking into consideration the characteristics of a required light distribution pattern and flickering of an image to be scanned. In addition, a motor is preferred as a drive unit whose rotating speed can be changed in accordance with various light distribution control. Thereby, a timing at which scanning is performed can be easily changed. As such a motor, a motor from which information on rotation timing can be acquired is preferred. Specifically, a DC brushless motor is preferred. When a DC brushless motor is used, information on rotation timing can be acquired from the motor itself, and hence equipment, such as an encoder, can be omitted.

Thus, in the rotating reflector 26 according to the present embodiment, the front of a vehicle can be scanned in the horizontal direction by using the light from the LED 28, when the shape and rotating speed of the blades 26*a* are devised. FIGS. 5A to 5E are views illustrating projected images in which the rotating reflector is at scanning positions corresponding to the states of FIGS. 4F to 4J, respectively. The unit of each of the vertical axis and the horizontal axis is degree (°), and irradiation ranges and irradiation positions are illustrated. As illustrated in FIGS. 5A to 5E, a projected image is moved in the horizontal direction by the rotation of the rotating reflector 26.

Figure 6A:
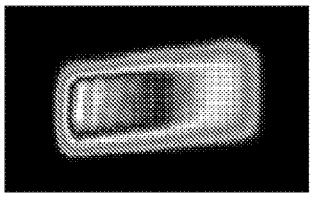
FIG. 6A is a view illustrating a light distribution pattern when a range of ±5° in the horizontal direction with respect to an optical axis is scanned by using the automotive headlamp according to the present embodiment.
Figure 6C:
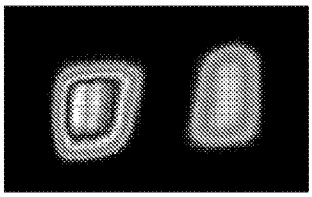
FIG. 6C is a view illustrating a state where a region of a light distribution pattern is shielded from light by using the automotive headlamp according to the present embodiment.
Figure 6E:
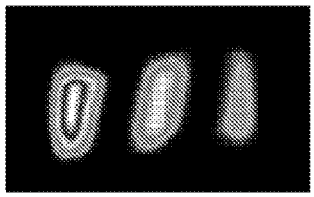
FIG. 6E is a view illustrating a state where a plurality of regions of a light distribution pattern are shielded from light by using the automotive headlamp according to the present embodiment.
Figure 6B:
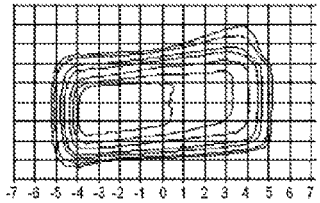
FIG. 6B is a view illustrating a light intensity distribution of the light distribution pattern illustrated in FIG. 6A.
Figure 6D:
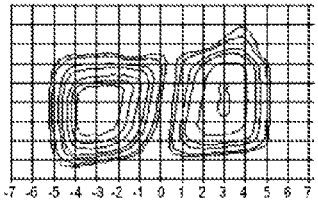
FIG. 6D is a view illustrating a light intensity distribution of the light distribution pattern illustrated in FIG. 6C.
Figure 6F:
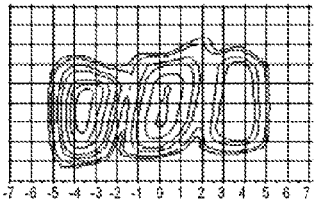
FIG. 6F is a view illustrating a light intensity distribution of the light distribution pattern illustrated in FIG. 6E.

FIG. 6A is a view illustrating a light distribution pattern when a range of ±5° in the horizontal direction with respect to the optical axis is scanned by using the automotive headlamp according to the present embodiment, FIG. 6B is a view illustrating a light intensity distribution of the light distribution pattern illustrated in FIG. 6A, FIG. 6C is a view illustrating a state where a region of a light distribution pattern is shielded from light by using the automotive headlamp according to the present embodiment, FIG. 6D is a view illustrating a light intensity distribution of the light distribution pattern illustrated in FIG. 6C, FIG. 6E is a view illustrating a state where a plurality of regions of a light distribution pattern are shielded from light by using the automotive headlamp according to the present embodiment, and FIG. 6F is a view illustrating a light intensity distribution of the light distribution pattern illustrated in FIG. 6E.

As illustrated in FIG. 6A, the automotive headlamp 10 according to the present embodiment can form a light distribution pattern for high-beam having a substantially rectangular shape by reflecting the light from the LED 28 with the rotating reflector 26 to scan a forward region with the reflected light. Thus, a desired light distribution pattern can be formed by the rotation in one direction of the rotating reflector 26, and hence it is not needed to be driven by a particular mechanism, such as a resonant mirror, and further limitations on the size of the reflecting surface are smaller than those on a resonant mirror. Accordingly, the light emitted from the light source can be used efficiently in lighting by selecting the rotating reflector 26 having a larger reflecting surface. That is, a maximum light intensity in a light distribution pattern can be enhanced. The rotating reflector 26 according to the present embodiment has a diameter approximately the same as that of the convex lens 30, and the area of the blades 26*a* can be made large in accordance with the diameter.

In addition, the automotive headlamp 10 comprising the optical unit according to the present embodiment can form a light distribution pattern for high-beam, in which an arbitrary region is shielded from light as illustrated in FIGS. 6C and 6E, by synchronizing the timing of turning on/off the LED 28 or a change in the emitted light intensity with the rotation of the rotating reflector 26. In addition, when a light distribution patter for high-beam is formed by changing the emitted light intensity of (by turning on/off) the LED 28 so as to be synchronized with the rotation of the rotating reflector 26, control can also be performed, in which the light distribution pattern is swiveled itself by shifting the phase of the change in the light intensity.

As described above, the automotive headlamp according to the present embodiment can form a light distribution pattern by scanning with the light from the LED, and can also form a light-shielded portion arbitrarily in part of the light distribution pattern by controlling a change in the emitted light intensity. Accordingly, a desired region can be accurately shielded from light by LEDs, the number of which is smaller than that of the case where a light-shielded portion is formed by turning off part of a plurality of LEDs. Further, the automotive headlamp 10 can form a plurality of light-shielded portions, and hence, even when a plurality of vehicles are present forward, the regions corresponding to the respective vehicles can be shielded from light.

Furthermore, the automotive headlamp 10 can perform light-shielding control without moving a basic light distribution pattern, and hence an uncomfortable feeling, which may be provided to a driver when light-shielding control is performed, can be reduced. Furthermore, the automotive headlamp 10 can swivel a light distribution pattern without moving the lamp unit 20, and hence the mechanism of the lamp unit 20 can be simplified. Accordingly, the automotive headlamp 10 is only required to include, as a drive unit for light distribution variable control, a motor necessary for the rotation of the rotating reflector 26, thereby the configuration of the automotive headlamp 10 can be simplified and it can be manufactured at low cost and in a small size.

In addition, the rotating reflector 26 according to the present embodiment also serves as a cooling fan for sending air to the LED 28 that is arranged in front of the rotating reflector 26, as illustrated in FIGS. 1 and 2. Accordingly, it is not needed to provide a cooling fan and a rotating reflector separately from each other, and hence the configuration of the optical unit can be simplified. In addition, by air cooling the LED 28 with the wind generated in the rotating reflector 26, a heat sink for cooling the LED 28 can be omitted or miniaturized, and hence the optical unit can be reduced in size, cost, and weight.

Alternatively, such a cooling fan is not necessarily required to have a function of directly sending air to the light source, and a cooling fan for generating a convection current in a heat release unit, such as a heat sink, may be adopted. The rotating reflector 26 and a heat sink may be arranged such that the LED 28 is cooled, for example, by generating, with the wind generated by the rotating reflector 26, a convection current near to a heat release unit, such as a heat sink, which is provided separately from the LED 28. Alternatively, the heat release unit may also be part of the light source, not only being a separate member, such as a heat sink.

Second Embodiment

Figure 7A:
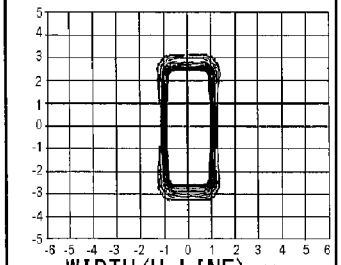
FIG. 7A is a view illustrating a projected image generated when the light from an LED is reflected by a plane mirror and then projected by an aspheric lens.
Figure 7B:
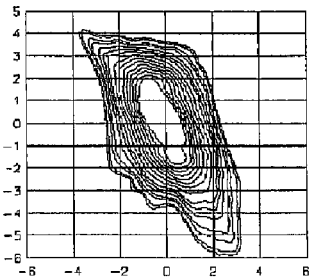
FIG. 7B is a view illustrating a projected image in an automotive headlamp according to First Embodiment.
Figure 7C:
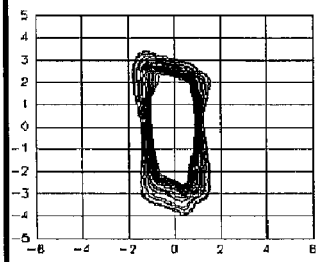
FIG. 7C is a view illustrating a projected image in an automotive headlamp according to Second Embodiment.

When the light from an LED is reflected and projected forward by a projection lens, the shape of a projected image does not necessarily match the shape of the light emitting surface of the LED. FIG. 7A is a view illustrating a projected image generated when the light from an LED is reflected by a plane mirror and then projected by an aspheric lens, FIG. 7B is a view illustrating a projected image in the automotive headlamp according to First Embodiment, and FIG. 7C is a view illustrating a projected image in an automotive headlamp according to Second Embodiment.

If a reflecting surface is planar, a projected image is similar to the shape of the light emitting surface of an LED, as illustrated in FIG. 7A. However, the blades 26*a*, which serve as reflecting surfaces, are twisted in the rotating reflector 26 according to First Embodiment, and hence a projected image is distorted as illustrated in FIG. 7B. Specifically, a projected image is blurred (irradiation range is widened) and inclined in First Embodiment. Accordingly, there are sometimes the cases where the shapes of a light distribution pattern and a light-shielded portion, which are formed by scanning a projected image, are inclined and a boundary between the light-shielded portion and an irradiated portion is unclear.

Figure 8:
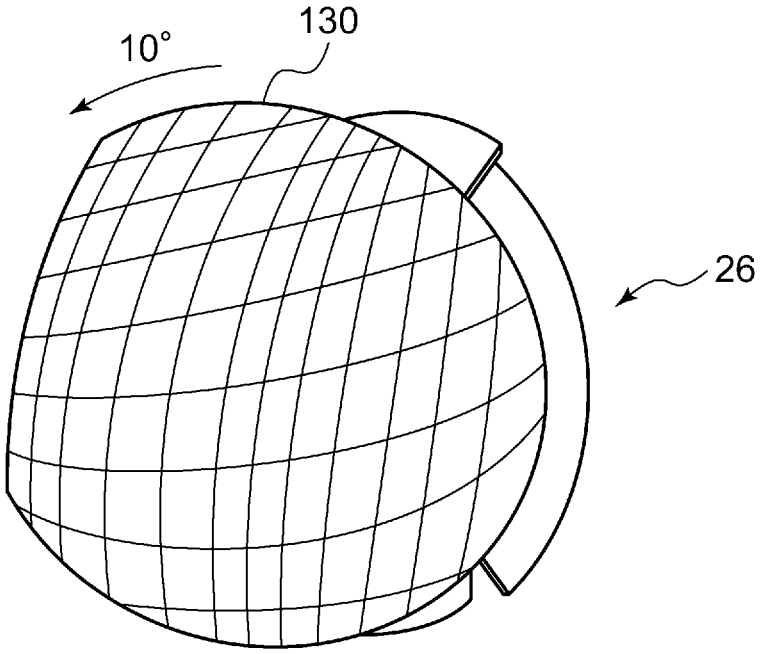
FIG. 8 is a front view of an optical unit according to Second Embodiment.
Figure 9A:
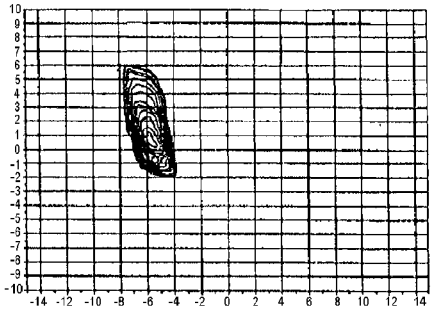
FIGS. 9A to 9E are views illustrating projected images in each of which a rotating reflector is rotated by 30° from the previous state in the optical unit according to the Second Embodiment.
Figure 9B:
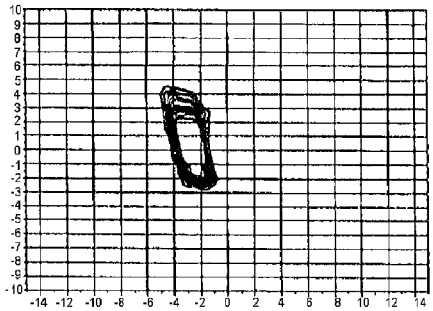
Figure 9C:
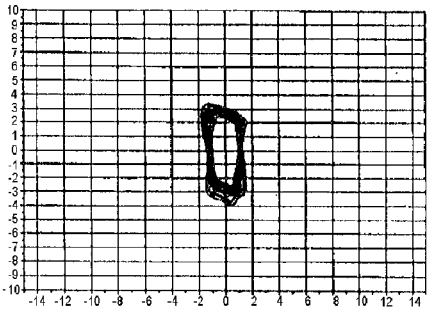
Figure 9D:
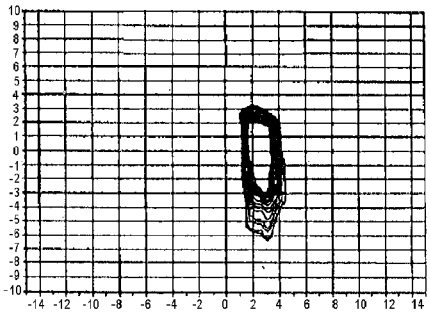
Figure 9E:
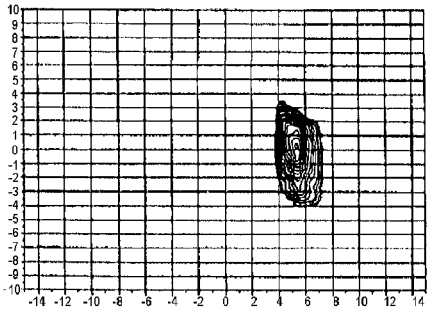

Accordingly, in Second Embodiment, an optical unit is configured to correct a distorted image by reflecting light with a curved surface. Specifically, a free-form surface lens is used as the convex lens, in an automotive headlamp according to Second Embodiment. FIG. 8 is a front view of the optical unit according to Second Embodiment.

The optical unit according to Second Embodiment includes the rotating reflector 26 and a projection lens 130. The projection lens 130 projects the light reflected by the rotating reflector 26 in a direction in which the optical unit radiates light. The projection lens 130 is a free-form surface lens by which an image of an LED, which has been distorted by being reflected with the reflecting surface of the rotating reflector 26, is corrected so as to be close to the shape of a light source itself (shape of the light emitting surface of the LED). The shape of the free-form surface lens may be appropriately designed in accordance with the twist or shape of a blade. In the optical unit according to the present embodiment, the image is corrected to be a shape close to a rectangle that is the shape of a light source, as illustrated in FIG. 7C. In addition, the maximum light intensity of a projected image by the optical unit according to Second Embodiment is increased to 146000 cds, while that of a projected image by the optical unit according to First Embodiment is 100000 cds (see FIG. 7B).

FIGS. 9A to 9E are views illustrating projected images in each of which the rotating reflector is rotated by 30° from the previous state in the optical unit according to the Second Embodiment. As illustrated in FIGS. 9A to 9E, projected images, which are less blurred than those in First Embodiment, are formed, and hence a desired region can be irradiated accurately with bright light.

Figure 10A:
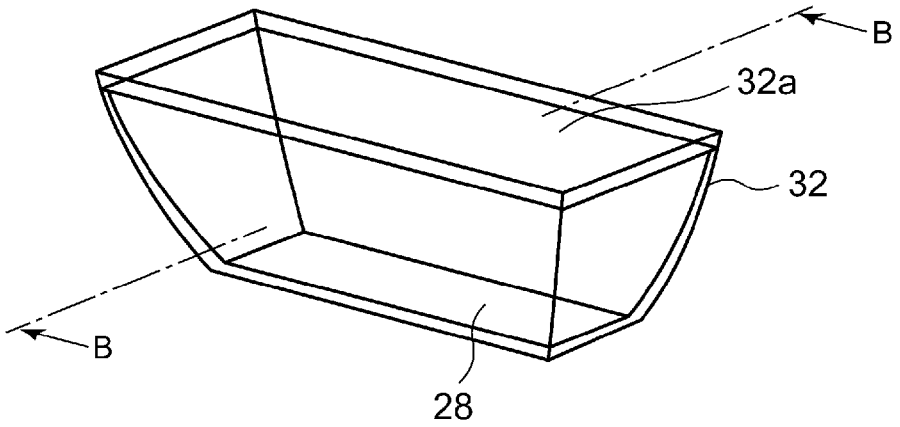
FIG. 10A is a perspective view of a light source according to Second Embodiment.
Figure 10B:
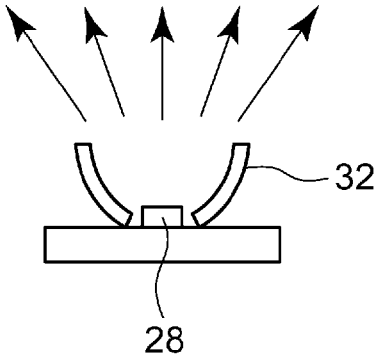
FIG. 10B is a sectional view, taken along B-B Line in FIG. 10A.

The light emitted from the LED 28 is spread as it is, and hence part of the light sometimes becomes useless without being reflected by the rotating reflector 26. Even if reflected by the rotating reflector 26, the resolution for a light-shielded portion tends to be decreased when a projected image becomes large. Accordingly, a light source in the present embodiment is formed by both the LED 28 and a CPC (Compound Parabolic Concentrator) 32 that concentrates the light from the LED 28. FIG. 10A is a perspective view of a light source according to Second Embodiment, and FIG. 10B is a sectional view, taken along B-B Line in FIG. 10A.

The CPC 32 is a concentrator having a box shape, on the bottom of which the LED 28 is arranged. The four side surfaces of the CPC 32 have been subjected to mirror finishing such that each of them has a parabolic shape whose focal point is located at the LED 28 or a region near thereto. Thereby, the light emitted by the LED 28 is concentrated and reflected forward. In this case, it can be assumed that an opening 32*a* of the CPC 32, the opening 32*a* having a rectangular shape, is the light emitting surface of the light source.

Third Embodiment

In the optical unit according to Second Embodiment, the shape of a projected image can be corrected to be a shape close to a rectangle that is the shape of the light source by an action of the free-form surface lens. However, when a light distribution pattern is formed by scanning a projected image thus corrected, there is still room for improvement.

Figure 11A:
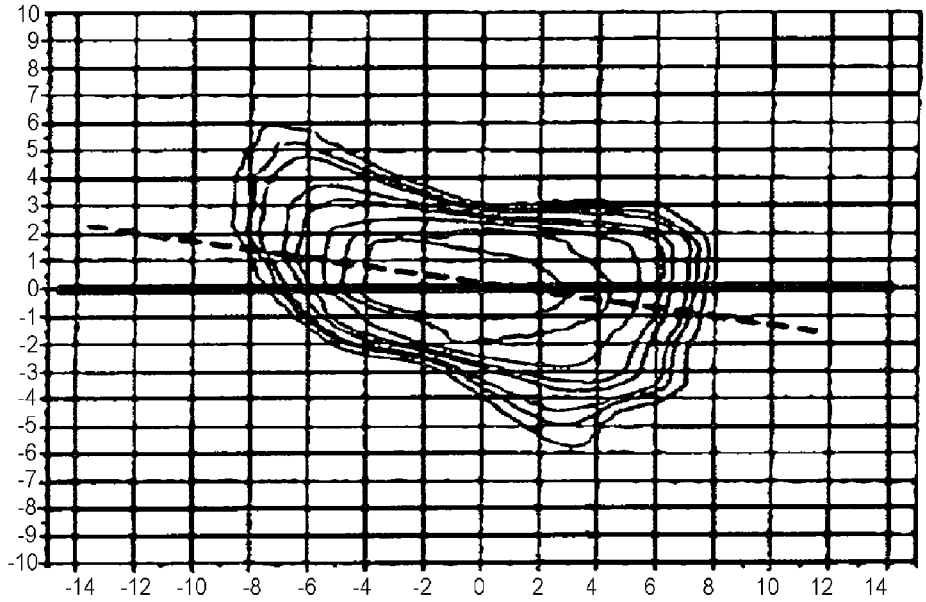
FIG. 11A is a view illustrating an irradiation pattern formed by the optical unit according to Second Embodiment.
Figure 11B:
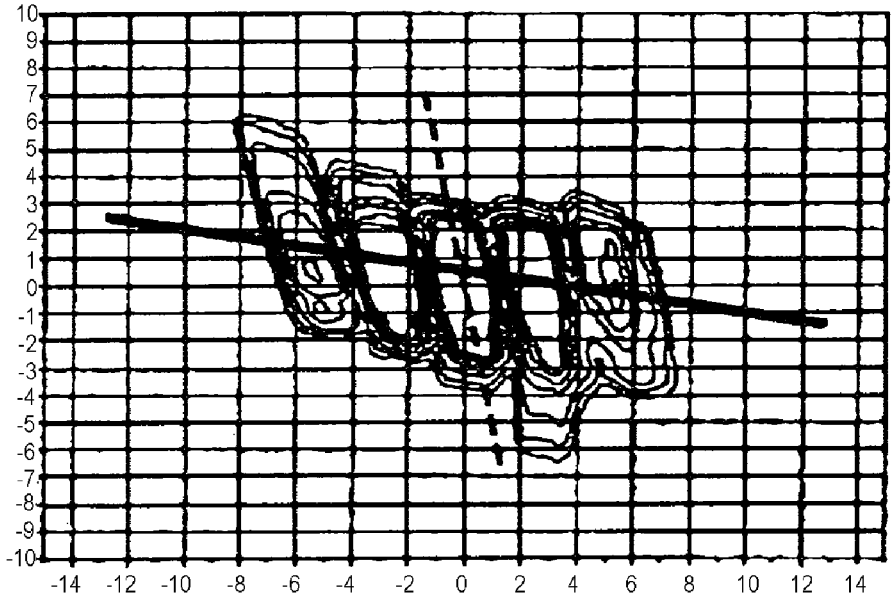
FIG. 11B is a view illustrating a state where projected images formed by the optical unit according to Second Embodiment are combined.
Figure 12A:
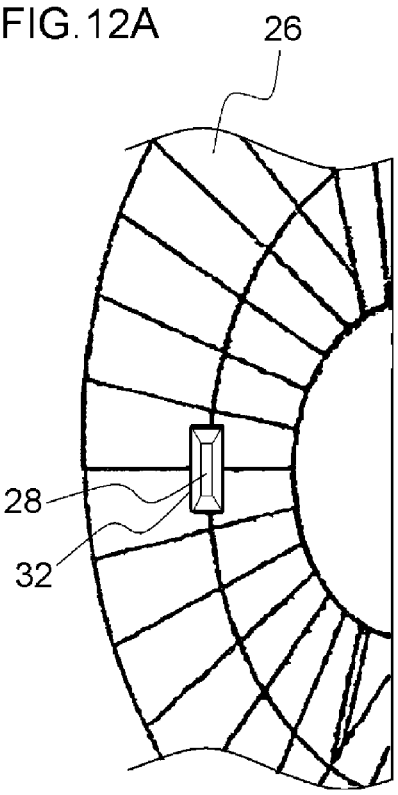
FIG. 12A is a view illustrating a state where a compound paraboloidal concentrator including an LED is arranged such that the longitudinal direction thereof is aligned with the vertical direction.
Figure 12B:
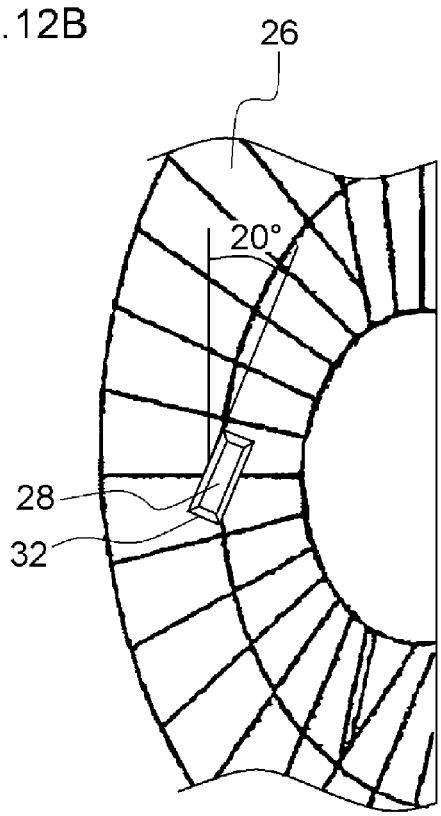
FIG. 12B is a view illustrating a state where the compound paraboloidal concentrator is arranged such that the longitudinal direction thereof is inclined with respect to the vertical direction.

FIG. 11A is a view illustrating an irradiation pattern formed by the optical unit according to Second Embodiment, and FIG. 11B is a view illustrating a state where projected images formed by the optical unit according to Second Embodiment are combined. FIG. 12A is a view illustrating a state where the CPC 32 including the LED 28 is arranged such that the longitudinal direction thereof is aligned with the vertical direction, and FIG. 12B is a view illustrating a state where the CPC 32 is arranged such that the longitudinal direction thereof is inclined with respect to the vertical direction.

When a light source is in the state illustrated in FIG. 12A, an irradiation pattern is inclined by approximately 10° with respect to the horizontal line, as illustrated in FIG. 11A. In addition, when a light source is in the state illustrated in FIG. 12A, each projected image is inclined by approximately 20° with respect to the vertical line, as illustrated in FIG. 11B. Accordingly, a configuration for correcting these inclinations will be described in the present embodiment.

At first, the inclination of an irradiation pattern can be corrected by rotating the whole optical system, including the projection lens 130 (see FIG. 8) that is a free-form surface lens, the rotating reflector 26, and the LED 28, by 10° with respect to the optical axis. In addition, the inclination of each projected image can be corrected by inclining a light source including the LED 28 and the CPC 32. Specifically, the light emitting surface of the light source is provided in a state where each side of the light emitting surface is inclined by 20° with respect to the vertical direction such that a projected image, which is projected forward by the projection lens 130, is close to upright, as illustrated in FIG. 12B.

Figure 13A:
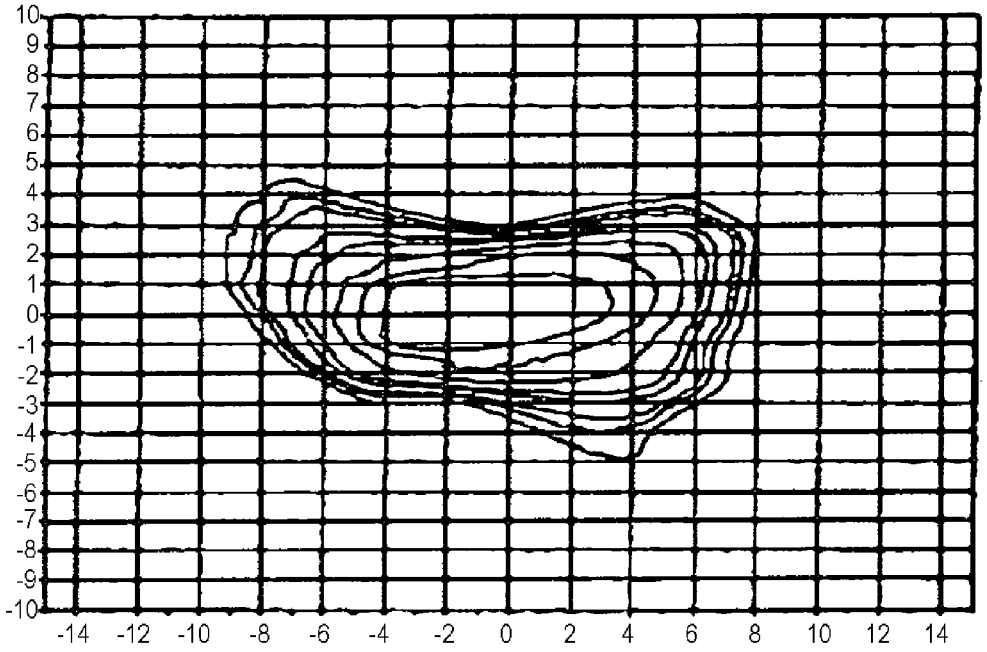
FIG. 13A is a view illustrating an irradiation pattern formed by an optical unit according to Third Embodiment.
Figure 13B:
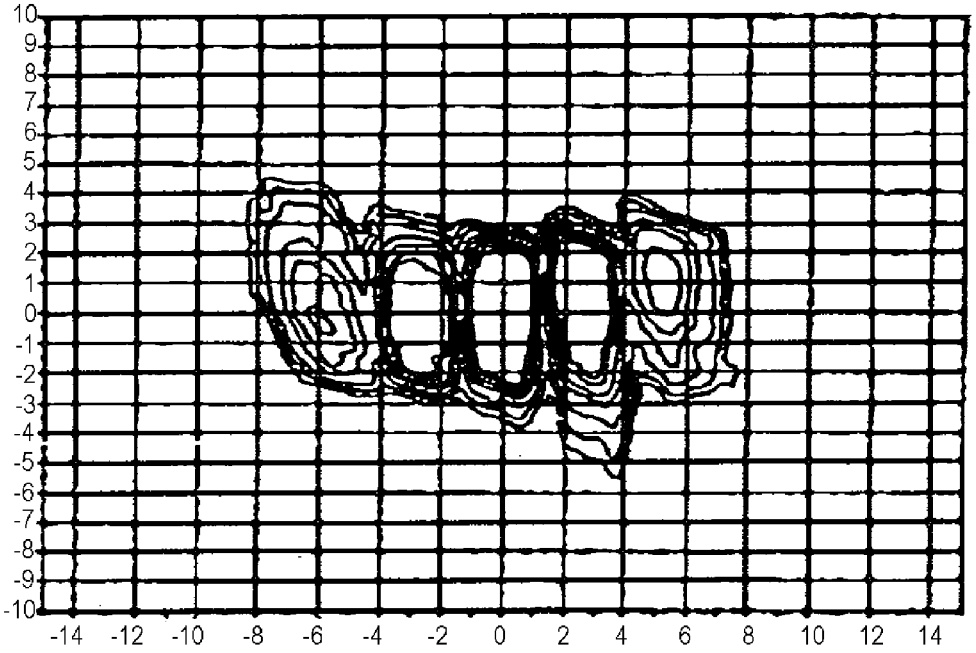
FIG. 13B is a view illustrating a state where projected images formed by the optical unit according to Third Embodiment are combined.

FIG. 13A is a view illustrating an irradiation pattern formed by an optical unit according to Third Embodiment, and FIG. 13B is a view illustrating a state where projected images formed by the optical unit according to Third Embodiment are combined. As illustrated in the views, the inclinations of an irradiation pattern and each projected image are corrected, and an ideal light distribution pattern can be formed. In addition, an irradiation pattern and a projected image can be corrected only by inclining the projection lens 130 and the LED 28, and hence adjustment for acquiring a desired light distribution pattern can be easily performed.

Fourth Embodiment

As in the optical units according to the aforementioned embodiments, a light distribution pattern for high-beam can be formed by a single light source. However, the case where a further bright irradiation pattern is required or the case where an LED with a further low light intensity is used for cost reduction is considered. Accordingly, an optical unit including a plurality of light sources will be described in the present embodiment.

Figure 14:
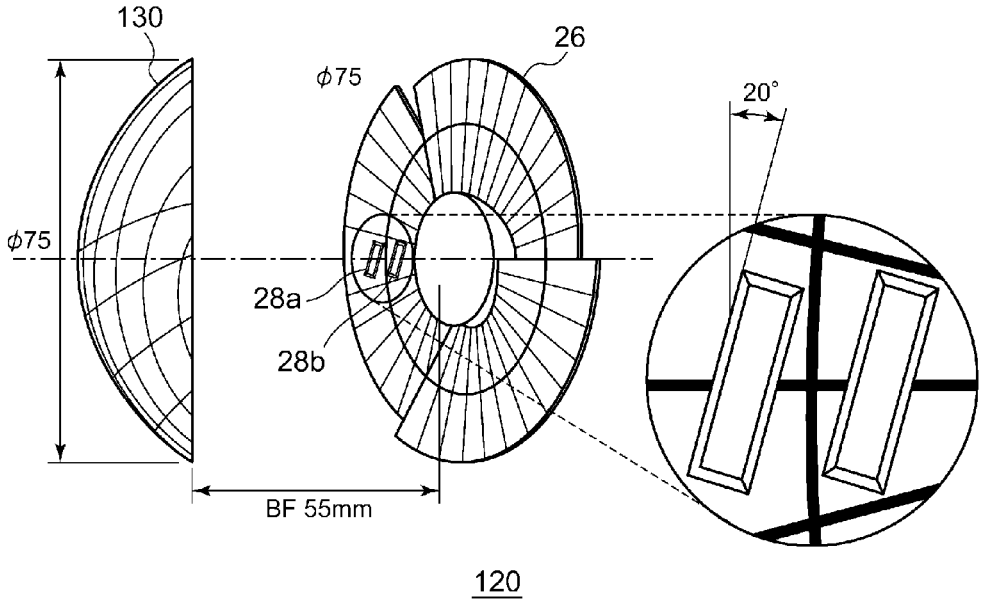
FIG. 14 is a side view schematically illustrating a lamp unit according to Fourth Embodiment.
Figure 15:
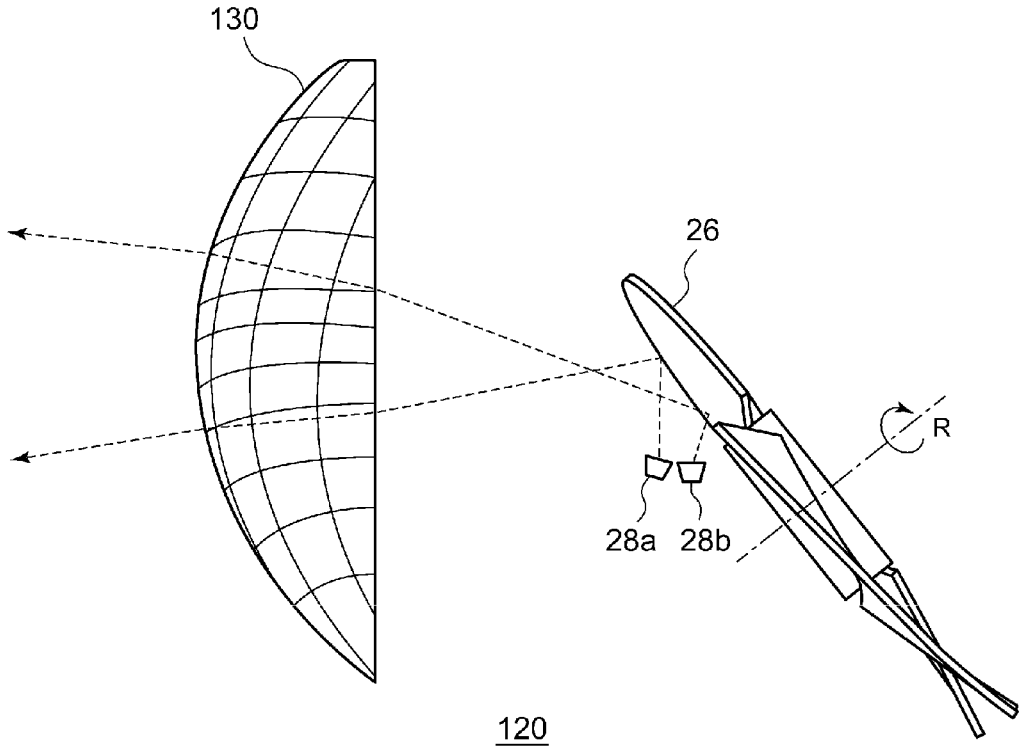
FIG. 15 is a top view schematically illustrating the lamp unit according to Fourth Embodiment.
Figure 16:
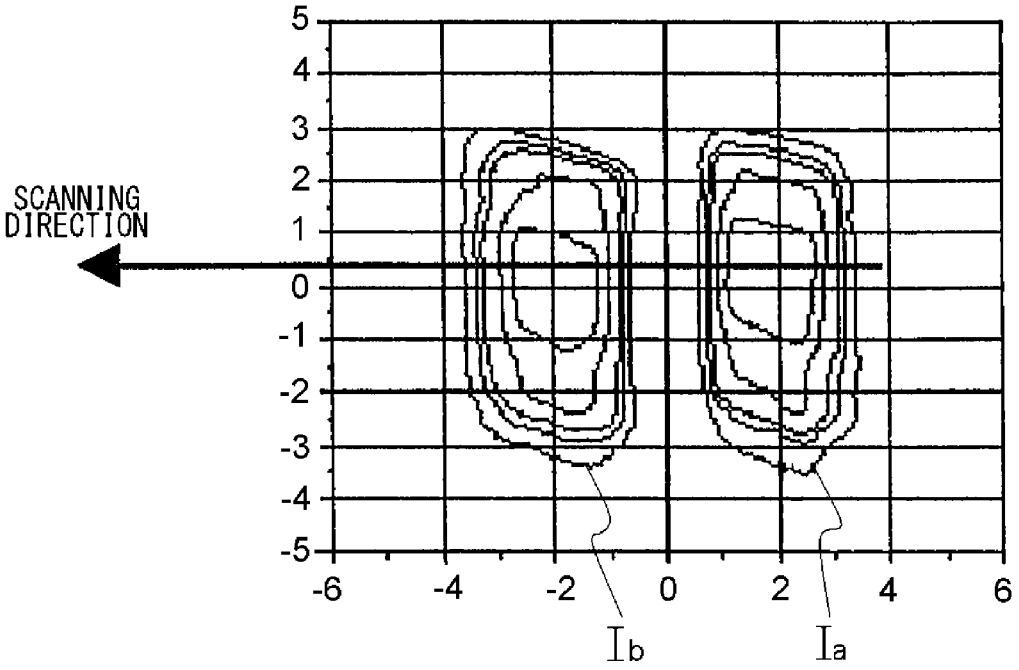
FIG. 16 is a view illustrating a projected image occurring when a rotating reflector is in the state illustrated in FIG. 14.

FIG. 14 is a side view schematically illustrating a lamp unit according to Fourth Embodiment. FIG. 15 is a top view schematically illustrating the lamp unit according to Fourth Embodiment. A lamp unit 120 according to Fourth Embodiment includes the projection lens 130, the rotating reflector 26, and two LEDs 28*a* and 28*b*. FIG. 16 is a view illustrating a projected image occurring when the rotating reflector 26 is in the state illustrated in FIG. 14. A projected image Ia is formed by the light from the LED 28*a* arranged forward, i.e., arranged near to the projection lens 130, while a projected image Ib is formed by the light from the LED 28*b* arranged backward, i.e., arranged away from the projection lens 130.

Figure 17A:
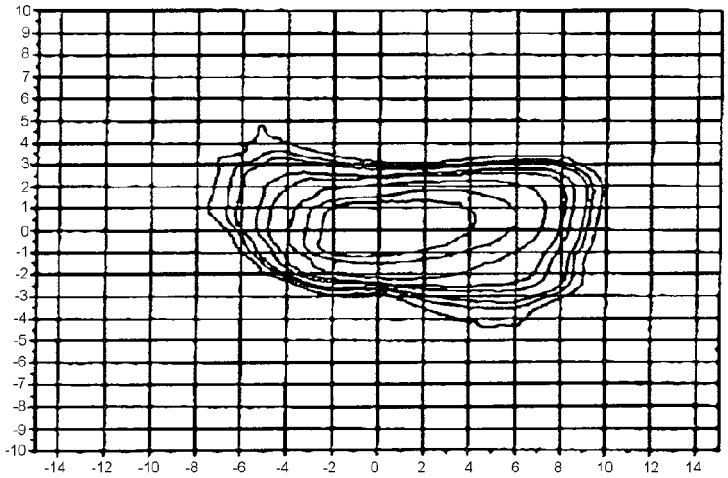
FIG. 17A is a view illustrating an irradiation pattern formed by an LED arranged forward.
Figure 17B:
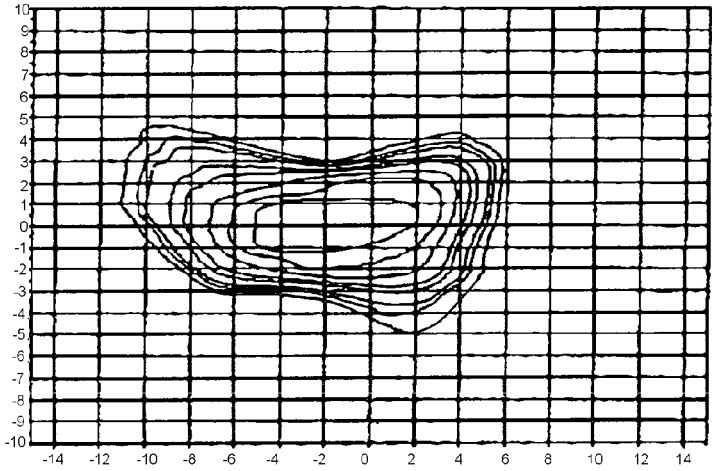
FIG. 17B is a view illustrating an irradiation pattern formed by an LED arranged backward.
Figure 17C:
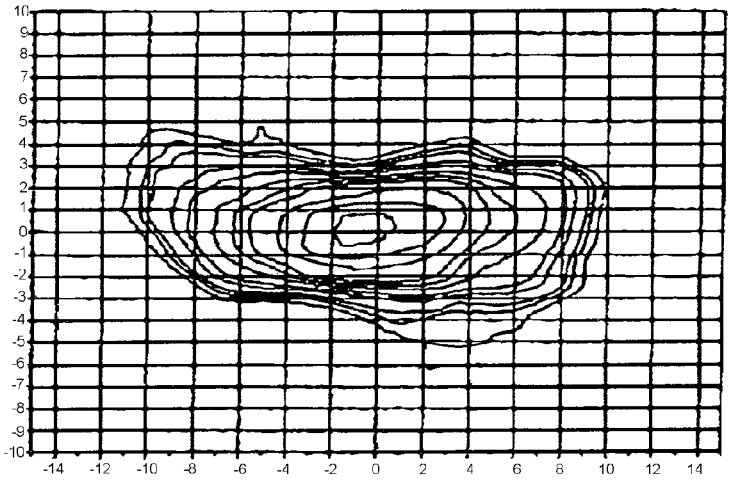
FIG. 17C is a view illustrating a combined light distribution pattern formed by the two LEDs.

FIG. 17A is a view illustrating an irradiation pattern formed by the LED 28*a* arranged forward, FIG. 17B is a view illustrating an irradiation pattern formed by the LED 28*b* arranged backward, and FIG. 17C is a view illustrating a combined light distribution pattern formed by the two LEDs. As illustrated in FIG. 17C, a desired light distribution pattern can also be formed by using a plurality of LEDs. In addition, a maximum light intensity, which is difficult to be attained by a single LED alone, is attained in the combined light distribution pattern.

Figure 18A:
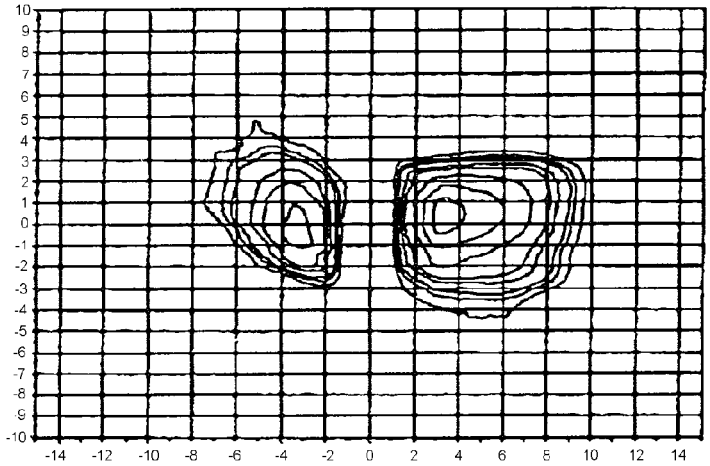
FIG. 18A is a view illustrating an irradiation pattern having a light-shielded portion formed by the LED arranged forward.
Figure 18B:
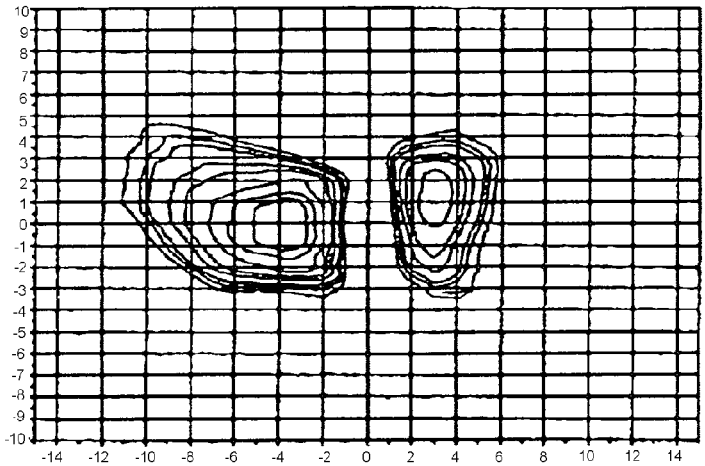
FIG. 18B is a view illustrating an irradiation pattern having a light-shielded portion formed by the LED arranged backward.
Figure 18C:
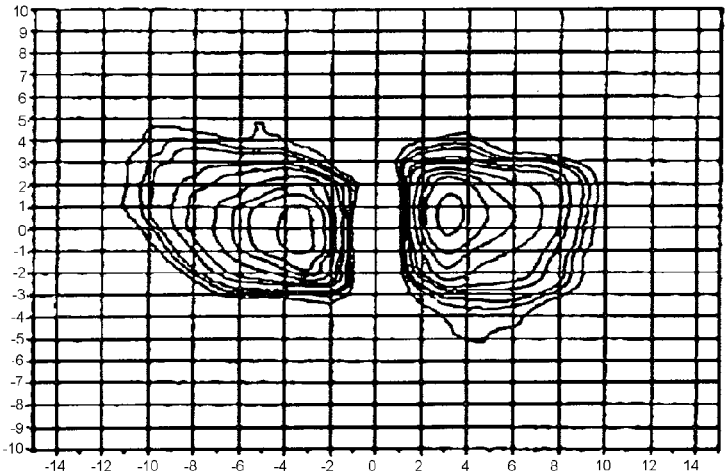
FIG. 18C is a view illustrating a combined light distribution pattern having a light-shielded portion formed by the two LEDs.

Subsequently, the case where a light-shielded portion is formed in a light distribution pattern by using the lamp unit 120 will be described. FIG. 18A is a view illustrating an irradiation pattern having a light-shielded portion formed by the LED 28*a* arranged forward, FIG. 18B is a view illustrating an irradiation pattern having a light-shielded portion formed by the LED 28*b* arranged backward, and FIG. 18C is a view illustrating a combined light distribution pattern having a light-shielded portion formed by the two LEDs. In order to form the light distribution patterns illustrated in FIGS. 18A and 18B, the timings of turning on/off the respective LEDs are appropriately shifted from each other to match the positions of the respective light-shielded portions. As illustrated in FIG. 18C, a desired light distribution pattern having a light-shielded portion can also be formed by using a plurality of LEDs. In addition, a maximum light intensity, which is difficult to be attained by a single LED, is attained in the combined light distribution pattern.

Fifth Embodiment

Figure 19:
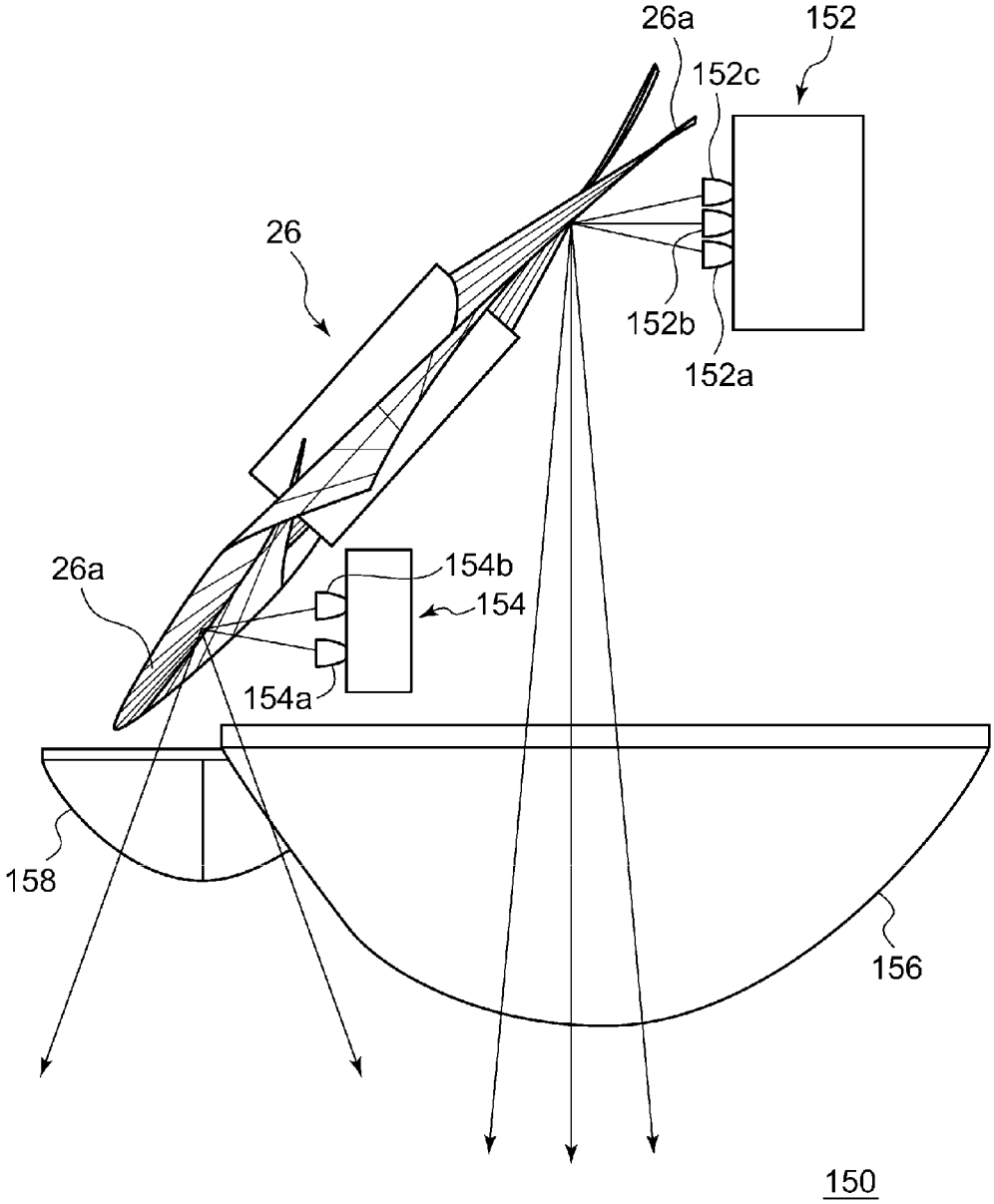
FIG. 19 is a top view schematically illustrating a configuration in which an optical unit according to Fifth Embodiment is included.

FIG. 19 is a top view schematically illustrating a configuration in which an optical unit according to Fifth Embodiment is included.

An optical unit 150 according to the present embodiment includes the rotating reflector 26 and a plurality of light sources each having LEDs as light emitting elements. Of the plurality of light sources, one light source 152 has a plurality of LED units 152*a*, 152*b*, and 152*c*. The plurality of LED units 152*a*, 152*b*, and 152*c* are ones for concentrating light and are arranged such that strong concentration of light, which is suitable for a light distribution pattern for high-beam and is oriented toward the front in the traveling direction, is achieved. Of the plurality of light sources, the other light source 154 has a plurality of LED units 154*a* and 154*b*. The plurality of LED units 154*a* and 154*b* are ones for diffusing light and are arranged such that diffuse light irradiating a wide range, which is suitable for a light distribution pattern for high-beam, is achieved. The number of the LED units included in each light source is not necessarily required to be two or more, but may be one when sufficient brightness can be achieved. In addition, it is not needed to always turn on all of the LED units, but part of which may be turned on in accordance with a situation where a vehicle travels and a forward state.

The light sources 152 and 154 are arranged such that the light emitted by each of them is reflected by each of the blades in the rotating reflector 26 and at a position different from that of the other. Specifically, the LED units 152*a*, 152*b*, and 152*c* for concentrating light, which are included in the light source 152, are arranged such that the light emitted by each of them is reflected by the fan-shaped blade 26*a* located away from a first projection lens 156. Accordingly, a change in the position of the light source 152, which is generated by the light being reflected with the fan-shaped blade 26*a*, can be projected forward by the first projection lens 156 having a large focal length (low projection magnification). As a result, when a forward region is scanned by rotating the rotating reflector 26 and by using the light emitted from the light source 152, a light distribution pattern can be formed, in which a scanning range is not too wide and a narrow range is irradiated further brightly.

On the other hand, the LED units 154*a* and 154*b* for diffusing light, which are included in the light source 154, are arranged such that the light emitted by each of them is reflected by the fan-shaped blade 26*a* located nearer to a second projection lens 158. Accordingly, a change in the position of the light source 154, which is generated by the light being reflected with the fan-shaped blade 26*a*, can be projected by the second projection lens 158 having a small focal length (high projection magnification). As a result, when a forward region is scanned by rotating the rotating reflector 26 and by using the light emitted from the light source 154, a light distribution pattern can be formed, in which a scanning range is widened and a wide range is irradiated.

Thus, by arranging the plurality of light sources 152 and 154 such that the light emitted by each of them is reflected at a position on the reflecting surface of the rotating reflector 26, the position being different from that of the other, a plurality of light distribution patterns can be formed and a new light distribution pattern can also be formed by combining those light distribution patterns, and hence a further ideal light distribution pattern can be designed easily.

Subsequently, the position of each projection lens will be described. As described above, the light emitted from each of the light sources 152 and 154 is incident to each projection lens by being reflected with the blade 26*a*. For each projection lens, this is equivalent to the fact that light is incident from a secondary light source of each of the light sources 152 and 154, which is virtually formed on the back side of the blade 26*a*. When a light distribution pattern is formed by scanning with light, it is important to project and scan a clear light source image, the least blurred as much as possible, in order to increase resolution.

Accordingly, it is preferable that each projection lens is arranged such that the position of the focal point thereof matches the position of the secondary light source. However, when it is taken into consideration that: the positions of the secondary light sources of the light sources 152 and 154 are changed with the rotation of the blade 26*a*; and various irradiation patterns are required, the positions of all of the secondary light sources are not necessarily required to match those of the focal points of the projection lenses.

Based on such knowledge, for example, the first projection lens 156 is arranged such that at least one of the secondary light sources of the light source 152, which are formed by the reflection with the blade 26*a*, passes near to the focal point of the first projection lens 156. The second projection lens 158 is arranged such that at least one of the secondary light sources of the light source 154, which are formed by the reflection with the blade 26*a*, passes near to the focal point of the second projection lens 158.

Figure 20:
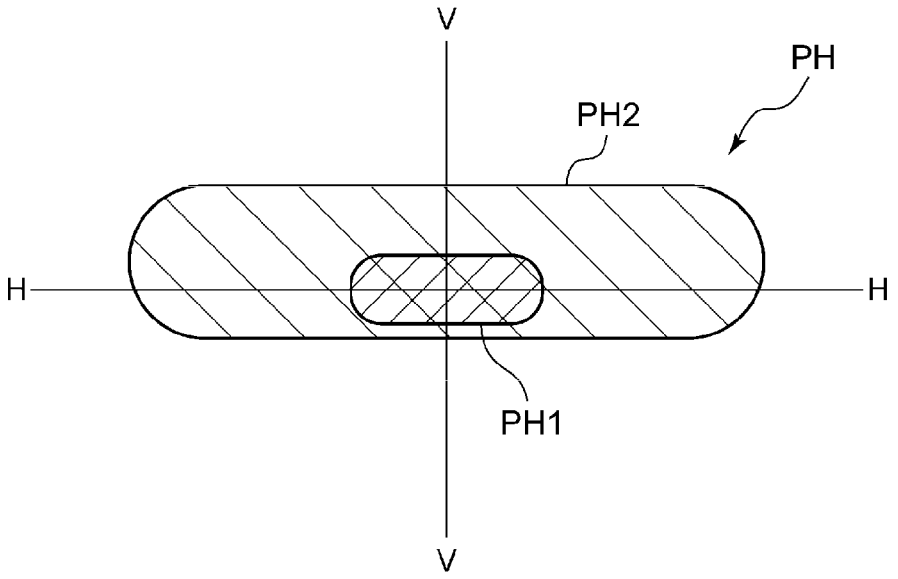
FIG. 20 is a view schematically illustrating a light distribution pattern formed by an automotive headlamp comprising the optical unit according to Fifth Embodiment.

FIG. 20 is a view schematically illustrating a light distribution pattern formed by an automotive headlamp comprising the optical unit according to Fifth Embodiment. The light distribution pattern for high-beam PH illustrated in FIG. 20 is composed of both a first light distribution pattern PH1, which is formed by the light source 152 and brightly irradiates the front ahead of a vehicle to a remote area, and a second light distribution pattern PH2, which is formed by the light source 154 and irradiates a wide range in front of the vehicle.

The optical unit 150 according to the present embodiment further includes both the first projection lens 156, which projects the light, emitted from the light source 152 and reflected by the rotating reflector 26, in the light radiation direction of the optical unit as the first light distribution pattern PH1, and the second projection lens 158, which projects the light, emitted from the light source 154 and reflected by the rotating reflector 26, in the light radiation direction of the optical unit as the second light distribution pattern PH2. Thereby, different light distribution patterns can be formed by the single rotating reflector by appropriately selecting each projection lens.

Figure 21A:
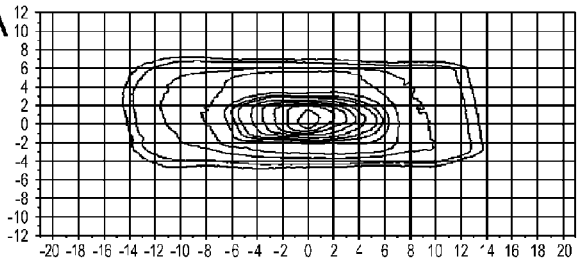
FIG. 21A is a view illustrating a light distribution pattern formed by respective light sources.
Figure 21B:
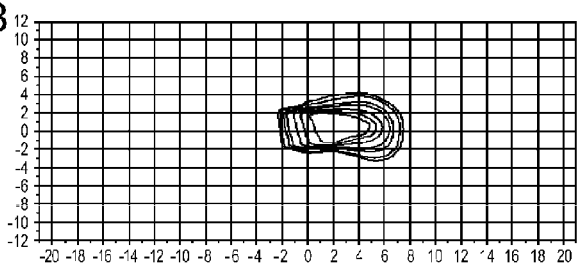
FIGS. 21B to 21F are views each illustrating an irradiation pattern formed by each of respective LED units.
Figure 21C:
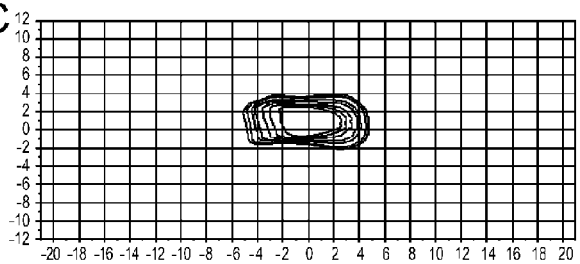
Figure 21D:
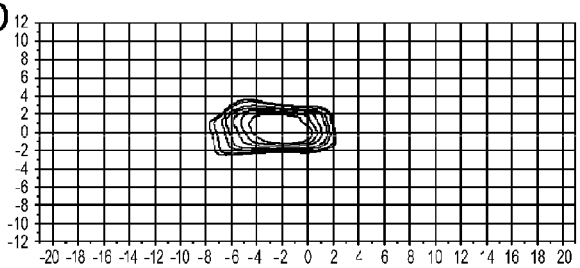
Figure 21E:
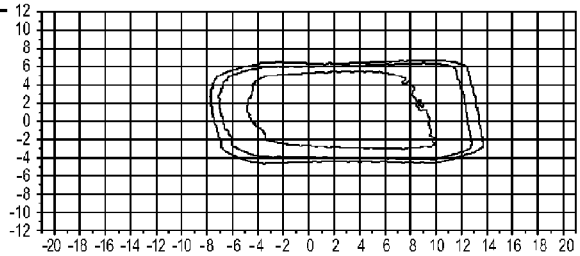
Figure 21F:
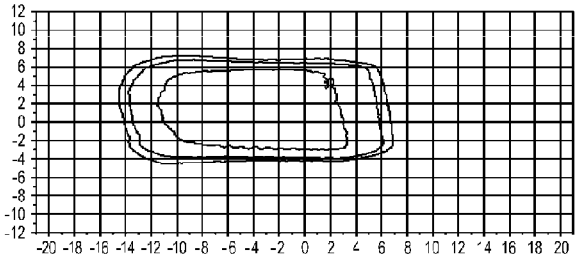

Subsequently, an irradiation pattern formed by each LED, by which the first light distribution pattern PH1 and the second light distribution pattern PH2 are formed, will be described. FIG. 21A is a view illustrating a light distribution pattern formed by the light sources 152 and 154, and FIGS. 21B to 21F are views each illustrating an irradiation pattern formed by each of the LED units 152*a*, 152*b*, 152*c*, 154*a*, and 154*b*. As illustrated in FIGS. 21B to 21D, the irradiation pattern formed by each of the LED units 152*a*, 152*b*, and 152*c* has a narrow irradiation region and a high maximum light intensity. On the other hand, as illustrated in FIGS. 21E and 21F, the irradiation pattern formed by each of the LED units 154*a* and 154*b* has a wide irradiation region, although a maximum light intensity is low. The light distribution pattern for high-beam illustrated in FIG. 21A can be formed by superimposing the irradiation patterns formed by the respective LEDs one on another.

Figure 22A:
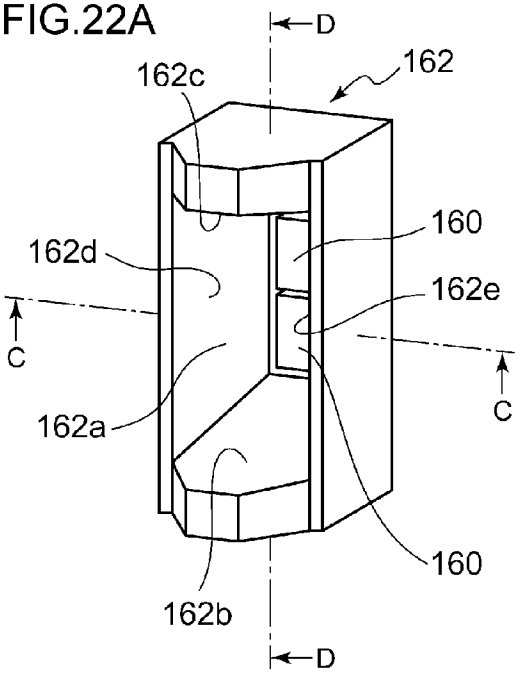
FIG. 22A is a perspective view of an LED unit according to Fifth Embodiment.
Figure 22B:
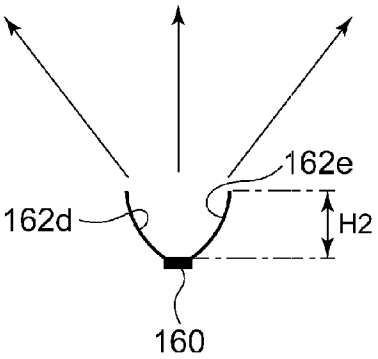
FIG. 22B is a sectional view, taken along C-C Line in FIG. 22A.
Figure 22C:
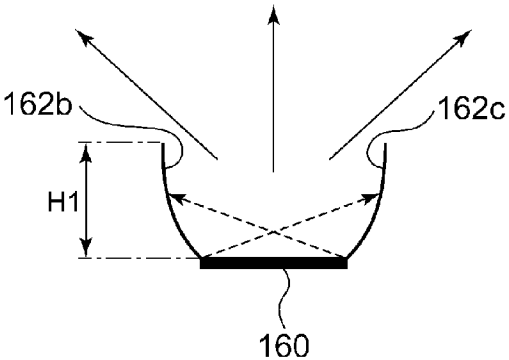
FIG. 22C is a sectional view, taken along D-D Line in FIG. 22A.

Subsequently, an LED unit included in each of the light sources 152 and 154 will be described in further detail. FIG. 22A is a perspective view of the LED unit according to Fifth Embodiment, FIG. 22B is a sectional view, taken along C-C Line in FIG. 22A, and FIG. 22C is a sectional view, taken along D-D Line in FIG. 22A. The LED unit 152*a* included in the light source 152 according to the present embodiment is formed by an LED 160 and a CPC 162 for concentrating the light from the LED 160. The LED units 152*a*, 152*b*, 152*c*, 154*a*, and 154*b* have the same configurations as each other, and hence the LED unit 152*a* will be described hereinafter as an example.

The CPC 162 is a member in which the LED 160 is arranged on the bottom thereof and an opening 162*a* thereof has a rectangular shape. The CPC 162 has four side surfaces (light concentrating surfaces) 162*b* to 162*e* each being formed from the bottom toward the opening 162*a* so as to concentrate the light from the LED 160. The four side surfaces 162*b* to 162*e* have been subjected to mirror finishing such that each of them has a parabolic shape whose focal point is located at the LED 160 or a region near thereto. Thereby, the light emitted by the LED 160 is concentrated and reflected forward. Herein, the light emitted from the LED 160 is likely to be diffused in the longitudinal direction of the opening 162*a*, as illustrated by the dotted lines in FIG. 22C. Accordingly, if the heights of all of the side surfaces are the same as each other, there are sometimes the cases where, of the light emitted by the LED 160, the light moving toward the longitudinal direction of the opening 162*a* cannot be sufficiently concentrated. That is, part of the light emitted obliquely from the opening without being reflected by the side surface does not reach the reflecting surface of the rotating reflector 26.

Accordingly, in the CPC 162 according to the present embodiment, the four side surfaces are formed in the following way: a height H1 of each of the side surfaces 162*b* and 162*c*, which are present at both end portions in the longitudinal direction of the opening 162*a*, is larger than a height H2 of each of the side surfaces 162*d* and 162*e*, which are present at both the end portions in the short direction thereof. Thereby, occurrence of diffuse light that does not reach the reflecting surface of the rotating reflector, of the light from the LED 160, is suppressed and the light incident to each projection lens is increased, and hence the light from the light source can be efficiently used in lighting.

Figure 23A:
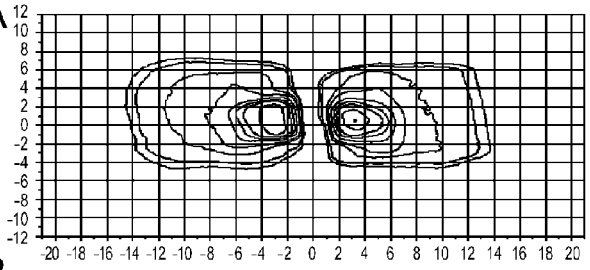
FIG. 23A is a view illustrating a light distribution pattern having a light-shielded portion formed by the respective light sources.
Figure 23B:
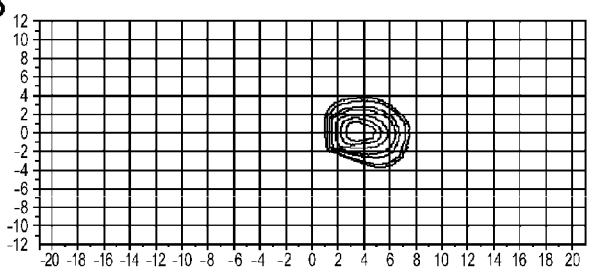
FIGS. 23B to 23F are views each illustrating an irradiation pattern having a light-shielded portion formed by each of the respective LED units.
Figure 23C:
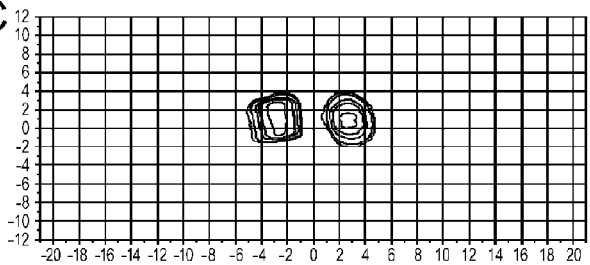
Figure 23D:
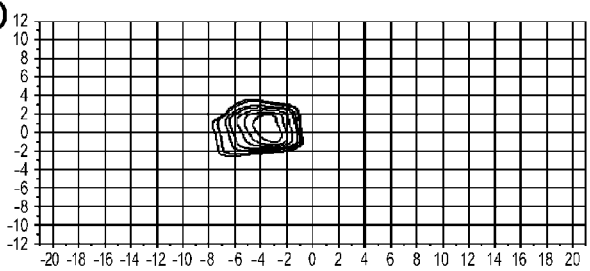
Figure 23E:
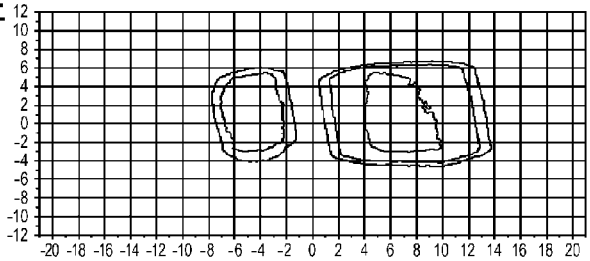
Figure 23F:
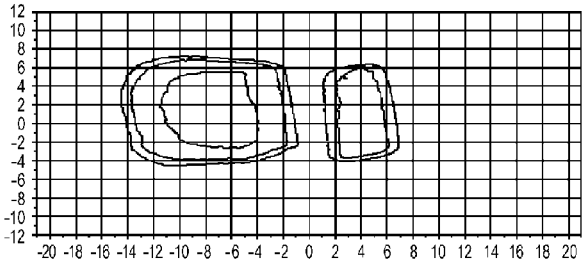

A light-shielded portion can also be formed in a light distribution pattern by using the optical unit 150 according to the present embodiment. FIG. 23A is a view illustrating a light distribution pattern having a light-shielded portion formed by the light sources 152 and 154, and FIGS. 23B to 23F are views each illustrating an irradiation pattern having a light-shielded portion formed by each of the LED units 152*a*, 152*b*, 152*c*, 154*a*, and 154*b*. As illustrated in FIGS. 23B to 23D, the irradiation pattern having a light-shielded portion formed by each of the LED units 152*a*, 152*b*, and 152*c* has a narrow irradiation region and a high maximum light intensity. On the other hand, as illustrated in FIGS. 23E and 23F, the irradiation pattern having a light-shielded portion formed by each of the LED units 154*a* and 154*b* has a wide irradiation region, although a maximum light intensity is low. The light distribution pattern for high-beam having a light-shielded portion, which is illustrated in FIG. 23A, can be formed by superimposing the irradiation patters formed by each LED one on another.

Sixth Embodiment

In the optical units according to the aforementioned respective embodiments, when light is simultaneously incident to both blades adjacent to each other, two emitted beams are simultaneously generated in directions different from each other; and hence both the end portions of a light distribution pattern shine simultaneously. In such a case, it is difficult to independently control the irradiation states at both the end portions of the light distribution pattern. Accordingly, it is made that both the end portions of a light distribution pattern are not irradiated simultaneously by turning off a light source at a timing when light is incident simultaneously to both blades adjacent to each other. On the other hand, if a light source is temporarily turned off at the aforementioned timing, the brightness at both the end portions of a light distribution pattern is decreased by some extent.

Figure 24:
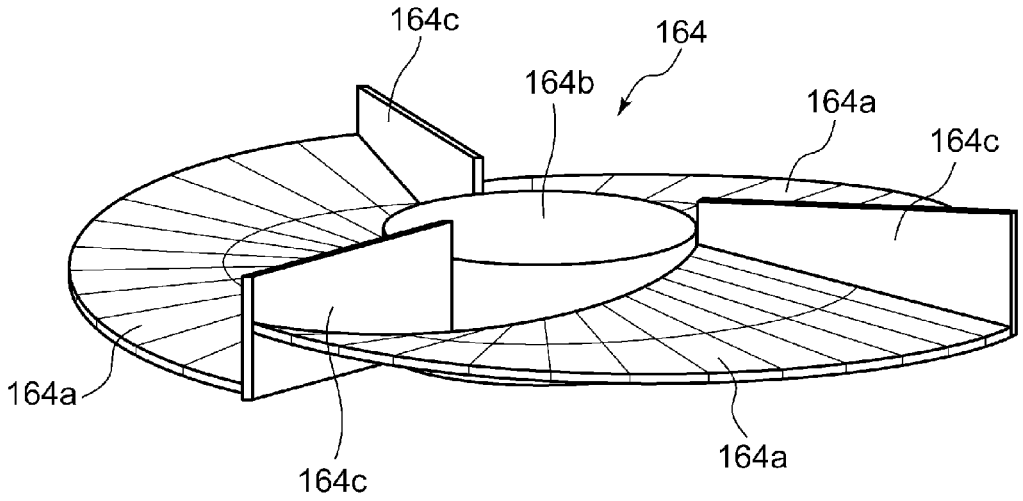
FIG. 24 is a perspective view of a rotating reflector according to Sixth Embodiment.

Accordingly, in the rotating reflector according to the present embodiment, a decrease in the brightness of a light distribution pattern is suppressed by providing a partition member between the blades adjacent to each other. FIG. 24 is a perspective view of a rotating reflector according to Sixth Embodiment. In a rotating reflector 164 illustrated in FIG. 24, three blades 164*a*, each having a shape similar to that in the aforementioned rotating reflector 26, are aligned in the circumferential direction of a tubular rotating part 164*b*. Each of the blades 164*a* functions as a reflecting surface. The rotating reflector 164 further includes three partition members 164*c*, each of which is provided between the blades 164*a* adjacent to each other to be extended in the rotational shaft direction and has a rectangular shape. Each of the partition members 164*c* is configured to suppress the light from a light source from being incident to the reflecting surface of one of the blades adjacent to each other in a state where the light therefrom is incident to the reflecting surface of the other thereof. Thereby, of the light from a light source that irradiates an end portion of one blade, the light moving toward an end portion of the adjacent blade can be blocked to some extent. That is, a period of time, during which light is simultaneously incident to both the blades adjacent to each other, is made short, and accordingly, a period of time, during which the light source is being turned off, can be made short, thereby allowing a decrease in irradiation efficiency to be minimized.

Subsequently, the suitable number of the blades provided in the rotating reflector will be discussed. The automotive headlamp comprising the optical unit according to each of the aforementioned embodiments irradiates a forward irradiation object (e.g., a vehicle, pedestrian, etc.) by reflecting the light from a light source and scanning a forward region while the blades in the rotating reflector are being rotated. Accordingly, the irradiation object sometimes becomes bright when irradiated with light and sometimes becomes dark when not irradiated with light; and hence the object sometimes looks flickering, depending on a condition. It is said that the flicker frequency, at which an irradiation object thus flickering in a resting state is no longer perceived as flickering, is required to be 80 Hz or higher.

It is also said that, in order to reduce a phenomenon in which a forward irradiation object looks powder-like when the line of sight is moved (a so-called stroboscopic effect), the flicker frequency is required to be 300 Hz or higher. Thus, when flickering and a stroboscopic effect are taken into consideration, the scanning frequency of the whole irradiation pattern is required to be 300 Hz or higher. In a very small region of an irradiation pattern, however, a stroboscopic effect is hardly caused in this region during traveling, and hence the scanning frequency is only required to be 80 Hz or higher in the narrow region.

Figure 25A:
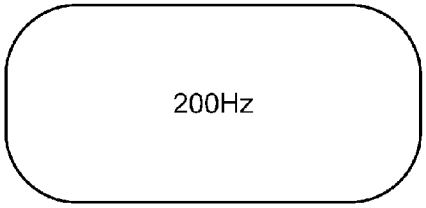
FIG. 25A is a view illustrating an ideal irradiation pattern when the shapes of respective blades are completely the same as each other.
Figure 25B:
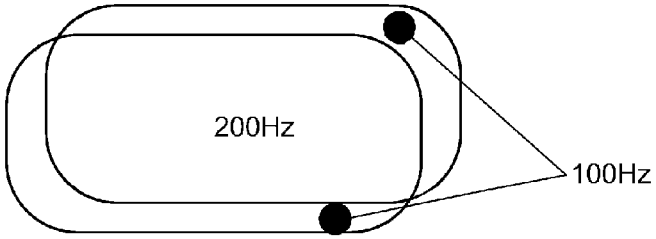
FIG. 25B is a view illustrating an irradiation pattern when an error is caused among the shapes of the respective blades.

It is sufficient to determine the number of the blades and the number of revolutions of the rotating reflector based on such knowledge. When the shapes of the plurality of blades are not completely the same as each other, the irradiation patterns scanned by the respective blades are not completely the same as each other, as well. FIG. 25A is a view illustrating an ideal irradiation pattern when the shapes of the respective blades are completely the same as each other, and FIG. 25B is a view illustrating an irradiation pattern when an error is caused among the shapes thereof. The irradiation patterns illustrated FIGS. 25A and 25B are formed when a rotating reflector having two blades is rotated at a number of revolutions of 100 rps.

When the shapes of the respective blades are completely the same as each other, an irradiation pattern scanned by any one of the blades is completely superimposed on those scanned by the others thereof, as illustrated in FIG. 25A. Accordingly, when an irradiation object is irradiated by such an irradiation pattern, the object flickers at 200 Hz. On the other hand, when an error is caused among the shapes of the respective blades, areas near to the outer peripheral portion of an irradiation pattern are shifted from each other depending on a scanning blade, while central portions are superimposed one on another, as illustrated in FIG. 25B. Accordingly, an irradiation object present in the central portion of an irradiation pattern flickers at 200 Hz, while that present near to the outer peripheral portion thereof flickers at 100 Hz, which is the same as the number of revolutions of the rotating reflector. Thus, when an error is caused among the shapes of the blades, it can be considered that flicker frequencies are different from each other, depending on irradiation regions of an irradiation pattern.

In the central portion of an irradiation pattern where influence of a stroboscopic effect is large, as described above, it is sufficient to determine the number of revolutions of the rotating reflector and the number of the blades such that the flicker frequency of an irradiation object becomes 300 Hz or higher. On the other hand, an area near to the outer peripheral portion of an irradiation pattern is narrow, and hence a stroboscopic effect is hardly caused. Accordingly, it is sufficient to determine the number of revolutions of the rotating reflector and the number of the blades such that the flicker frequency of an irradiation object becomes 80 Hz or higher in order that the flickering of the irradiation object flickering at a resting state is not perceived.

For example, in the case where the number of the blades in the rotating reflector is two, the scanning frequency in the central portion of an irradiation pattern becomes 300 Hz or higher and that in an area near to the outer peripheral portion thereof becomes 150 Hz or higher, when the number of revolutions of the rotating reflector is 150 rps or more. Similarly, in the case where the number of the blades in the rotating reflector is three, the scanning frequency in the central portion of an irradiation pattern becomes 300 Hz or higher and that in an area near to the outer peripheral portion thereof becomes 100 Hz or higher, when the number of revolutions of the rotating reflector is 100 rps or more. In the case where the number of the blades in the rotating reflector is four, the scanning frequency in the central portion of an irradiation pattern becomes 320 Hz or higher and that in an area near to the outer peripheral portion thereof becomes 80 Hz or higher, when the number of revolutions of the rotating reflector is 80 rps or more. In the case where the number of the blades in the rotating reflector is five, the scanning frequency in the central portion of an irradiation pattern becomes 400 Hz or higher and that in an area near to the outer peripheral portion thereof becomes 80 Hz or higher, when the number of revolutions of the rotating reflector is 80 rps or more. In the case where the number of the blades in the rotating reflector is six, the scanning frequency in the central portion of an irradiation pattern becomes 480 Hz or higher and that in an area near to the outer peripheral portion thereof becomes 80 Hz or higher, when the number of revolutions of the rotating reflector is 80 rps or more.

Thus, by appropriately selecting the number of the blades in the rotating reflector and number of revolutions of the rotating reflector, occurrence of flickering or a stroboscopic effect of an irradiation object in an irradiation pattern can be reduced. Herein, it is desirable that the number of revolutions is low from the viewpoint of the durability of a drive source (e.g., motor) for driving the rotating reflector. On the other hand, a light source is turned off at a timing when a boundary portion between the blades adjacent to each other is irradiated, and hence a period of time, during which a light source is being turned off, is increased when the number of the blades is large. Accordingly, it is desirable that the number of the blades is small from the viewpoint of efficient use of the light from a light source. Accordingly, the number of revolutions of the rotating reflector according to the present embodiment is preferably 80 rps and higher and lower than 150 rps. In addition, the number of the blades is preferably two, three, or four.

Figure 26:
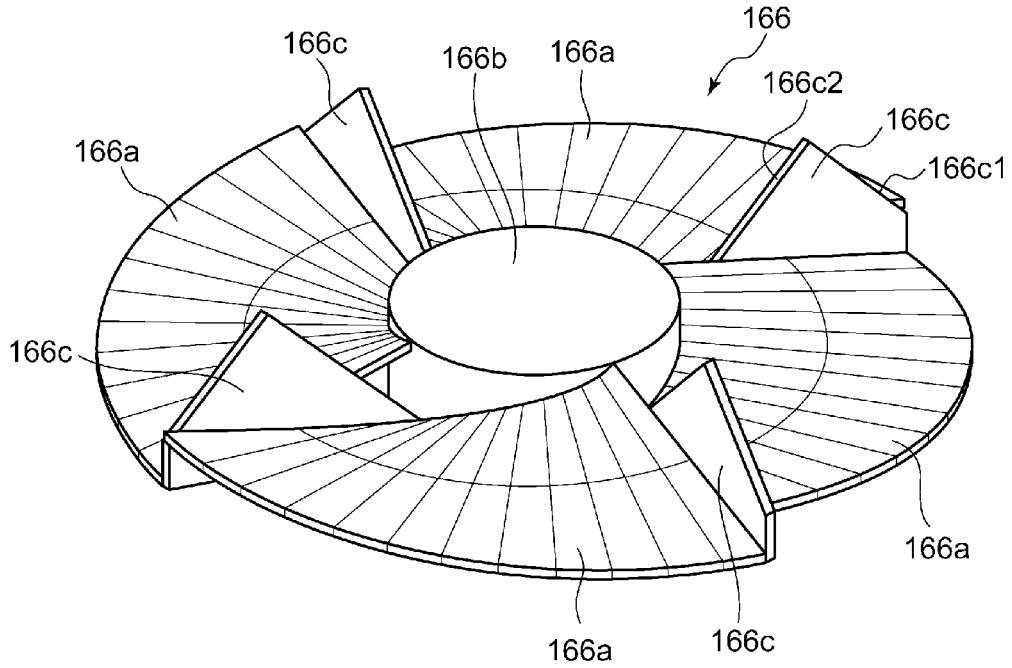
FIG. 26 is a perspective view of a rotating reflector according to a variation of Sixth Embodiment.

Hereinafter, the rotating reflector having four blades will be described. The blow capability of the optical unit is enhanced by increasing the number of blades in this way. FIG. 26 is a perspective view of a rotating reflector according to a variation of Sixth Embodiment, and FIG. 27 is a side view of the rotating reflector illustrated in FIG. 26.

Figure 27:
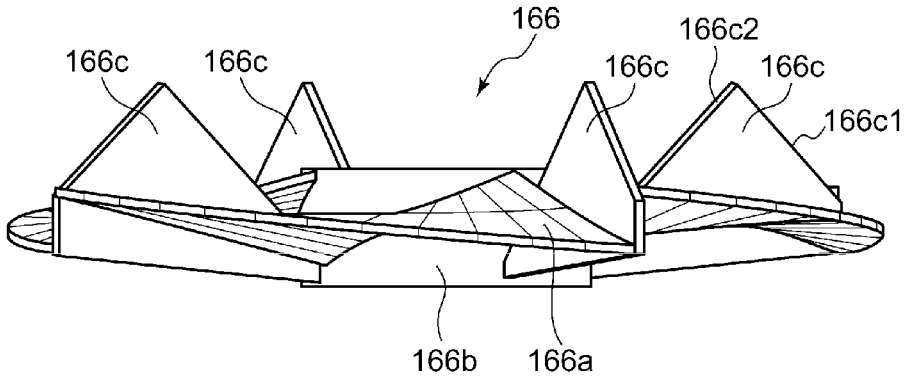
FIG. 27 is a side view of the rotating reflector illustrated in FIG. 26.

In a rotating reflector 166 illustrated in FIGS. 26 and 27, four blades 166*a* are aligned in the circumferential direction of a tubular rotating part 166*b*. Each of the blades 166*a* has a fan-like shape whose central angle is 90°, and is twisted similarly to the aforementioned rotating reflector. Each of the blades 166*a* functions as a reflecting surface. The rotating reflector 166 further includes four partition plates 166*c*, each of which is provided between the blades 166*a* adjacent to each other and is extended in the rotational shaft direction. Each of the partition plates 166*c* is configured to suppress the light from a light source from being incident to the reflecting surface of one of the blades adjacent to each other in a state where the light therefrom is incident to the reflecting surface of the other thereof. Thereby, of the light from a light source that irradiates an end portion of one blade, the light moving toward an end portion of the adjacent blade can be blocked to some extent. That is, a period of time, during which light is simultaneously incident to both the blades adjacent to each other, is made short, and accordingly, a period of time, during which the light source is being turned off, can be made short, thereby allowing a decrease in irradiation efficiency to be minimized. Herein, each of the partition plates 166*c* has, in its upper portion, two oblique sides 166*c*1 and 166*c*2 that are inclined with respect to the rotational shaft.

Figure 28:
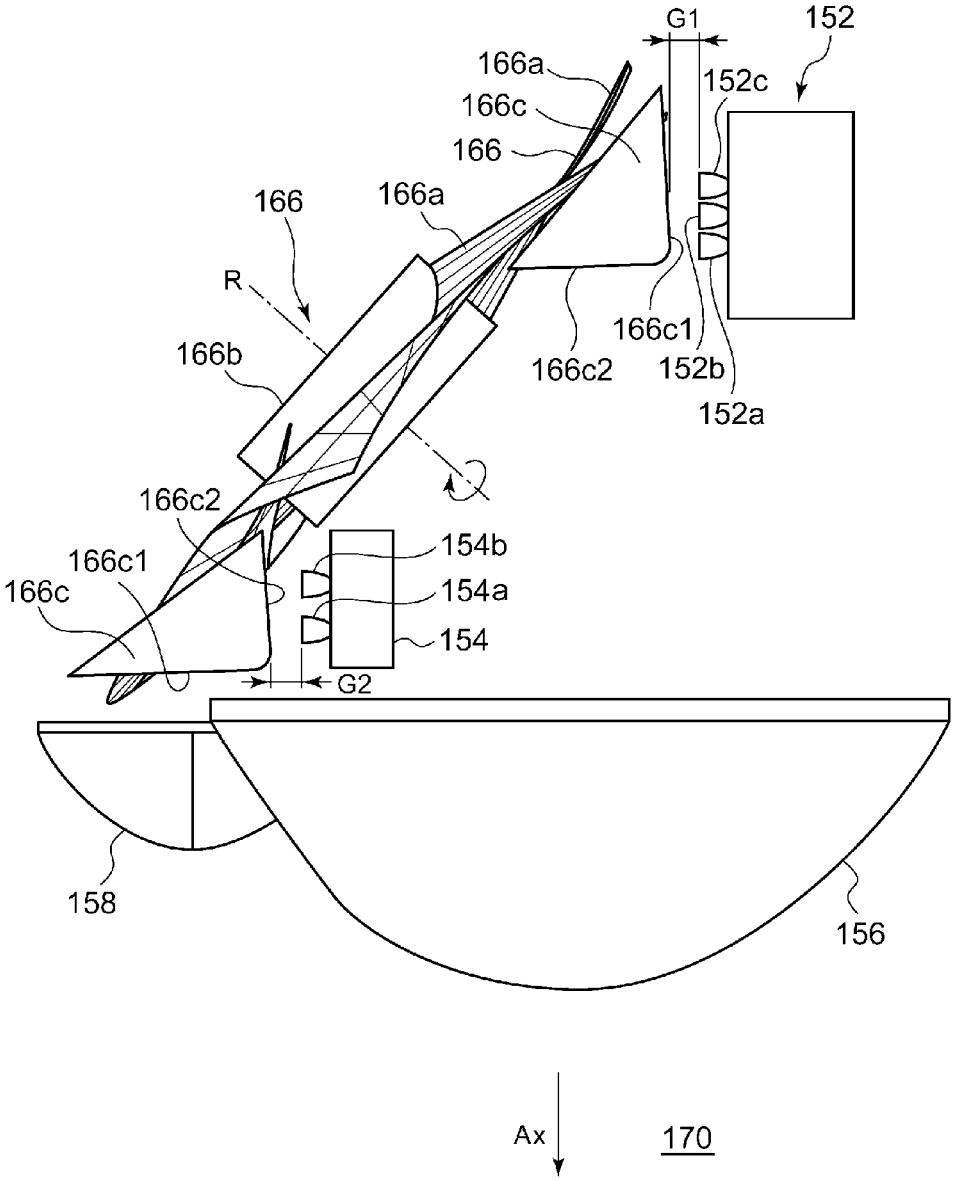
FIG. 28 is a top view schematically illustrating a configuration in which an optical unit according to Sixth Embodiment is included.

FIG. 28 is a top view schematically illustrating a configuration in which an optical unit according to Sixth Embodiment is included. Configurations and members similar to those in the optical unit according to each of the aforementioned embodiments will be denoted with like reference numerals and description thereof will be appropriately omitted.

An optical unit 170 according to the present embodiment includes the aforementioned rotating reflector 166 and the aforementioned plurality of the light sources 152 and 154. In the rotating reflector 166, the partition plate 166*c* is provided between the blades 166*a* adjacent to each other. The rotating reflector 166 is arranged in the optical unit 170 such that the rotational shaft R of the rotating reflector 166 is inclined with respect to the optical Axis Ax of the optical unit 170.

The shape of the oblique side 166*c*1 of the partition plate 166*c* is set so as to pass near to the opening of each of the LED units 152*a*, 152*b*, and 152*c* at a position where the oblique side 166*c*1 faces the light source 152. The oblique side 166*c*1 also has a shape in which, when passing the front of each of the LED units 152*a*, 152*b*, and 152*c*, the oblique side 166*c*1 becomes approximately parallel to the alignment direction of the LED units 152*a*, 152*b*, and 152*c*. Accordingly, the distance (gap G1) between the oblique side 166*c*1 and each of the LED units 152*a*, 152*b*, and 152*c*, which is generated when the oblique side 166*c*1 passes the front thereof, becomes uniform. As a result, the timing of turning off each of the LED units can be timed with each other. Herein, it is desirable that the gap G1 is approximately between 1 to 2 mm. Thereby, in a state where the light from the light source is incident to the reflecting surface of one of the blades adjacent to each other, the light therefrom can be prevented from being incident to the reflecting surface of the other of the blades, immediately before the light source passes just above the partition plate.

On the other hand, the shape of the oblique side 166*c*2 of the partition plate 166*c* is set so as to pass near to the opening of each of the LED units 154*a* and 154*b* at a position where the oblique side 166*c*2 faces the light source 154. The oblique side 166*c*2 also has a shape in which, when passing the front of each of the LED units 154*a* and 154*b*, the oblique side 166*c*2 becomes approximately parallel to the alignment direction of the LED units 154*a* and 154*b*. Accordingly, the distance (gap G2) between the oblique side 166*c*2 and each of the LED units 154*a* and 154*b*, which is generated when the oblique side 166*c*2 passes the front thereof, becomes uniform. As a result, the timing of turning off each of the LED units can be timed with each other. Herein, it is desirable that the gap G2 is approximately between 1 to 2 mm. Thereby, in a state where the light from the light source is incident to the reflecting surface of one of the blades adjacent to each other, the light therefrom can be prevented from being incident to the reflecting surface of the other of the blades, immediately before the light source passes just above the partition plate.

Thus, the partition plate 166*c* can suppress the light from the light source from being incident to the reflecting surface of one of the blades adjacent to each other, in a state where the light therefrom is incident to the reflecting surface of the other of the blades; and hence a period of time, during which the light source is being turned off, can be made short. As a result, a decrease in irradiation efficiency as an optical unit can be minimized.

Seventh Embodiment

Figure 29:
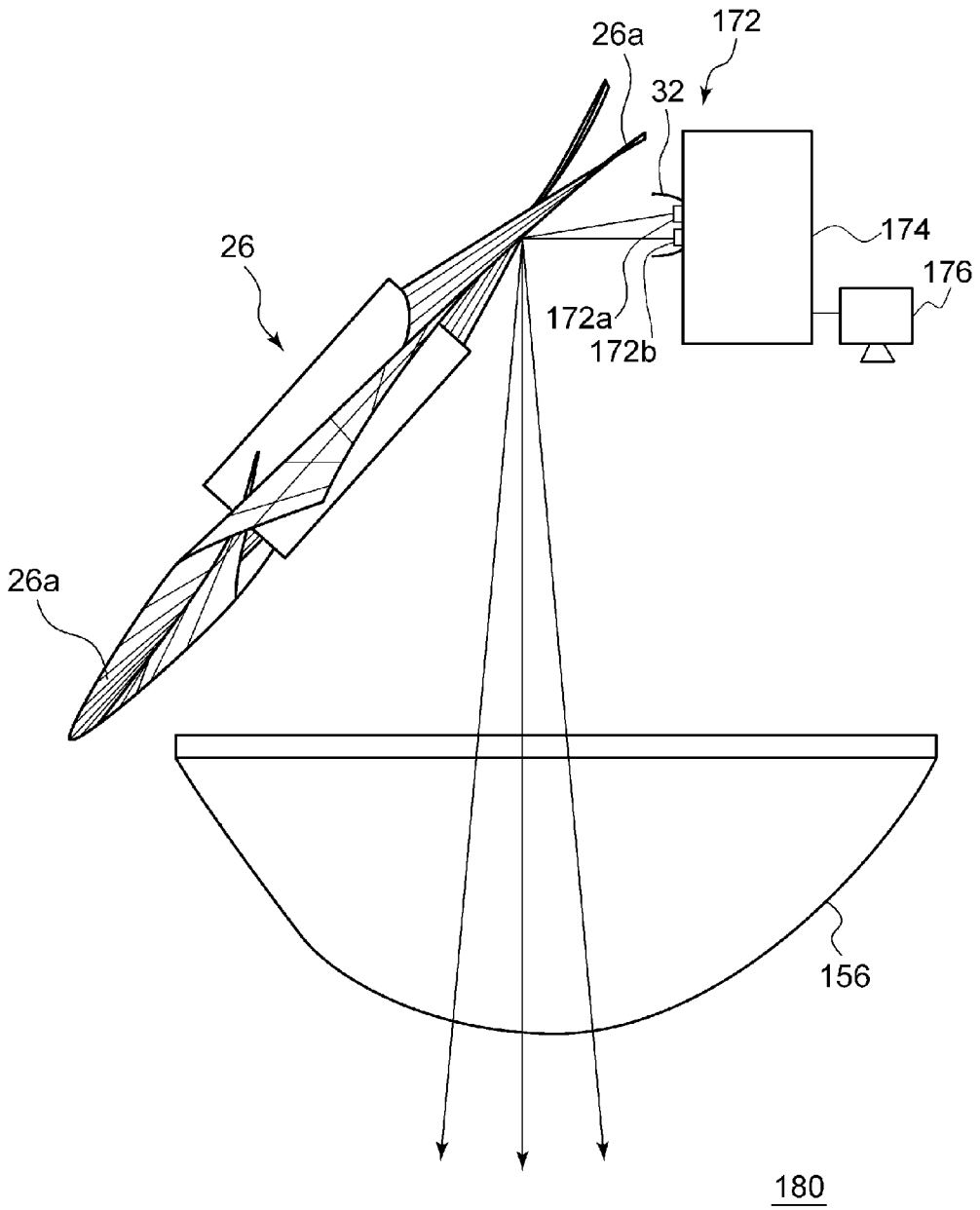
FIG. 29 is a top view schematically illustrating a configuration in which an optical unit according to Seventh Embodiment is included.

In the present embodiment, a plurality of types of LEDs, having emitted light colors different from each other as light emitting elements, are used as a light source. FIG. 29 is a top view schematically illustrating a configuration in which an optical unit according to Seventh Embodiment is included. Hereinafter, an LED will be described as an example of a light emitting element, but an EL element or LD element may also be adopted.

An optical unit 180 according to the present embodiment includes the rotating reflector 26 and a light source 172 having a plurality of types of LEDs each emitting light having a color different from those of the others. In the light source 172, a plurality of LED units 172*a* and 172*b* are formed on the bottom of the CPC 32. In the LED units 172*a* and 172*b*, LEDs each emitting light having a color different from that of the light emitted from the other, are mounted, respectively. For example, an LED that emits blue light may be mounted in the LED unit 172*a* and an LED that emits yellow light may be mounted in the LED unit 172*b*.

The light source 172 is arranged such that the light having a first color emitted from the LED unit 172*a* and the light having a second color emitted from the LED unit 172*b* are reflected by the blades in the rotating reflector 26. Reflecting surfaces of the rotating reflector 26 are provided such that a predetermined light distribution pattern is formed with the light having the first color and the light having the second color, which have been reflected by the rotation of the rotating reflector 26, being superimposed one on another.

Accordingly, the optical unit 180 can form a predetermined light distribution pattern by the rotation in one direction of the rotating reflector 26. Further, a light distribution pattern having a color, which cannot be achieved by one type of LEDs alone, can be formed by a plurality of types of the LED units 172*a* and 172*b* having emitted light colors different from each other. For example, when an LED that emits blue light is mounted in the LED unit 172*a* and an LED that emits yellow light is mounted in the LED unit 172*b*, the optical unit 180 can form a light distribution patter having white color.

Thus, white light can be achieved without phosphor by the optical unit 180 including a plurality of types of LEDs that emit light having colors different from each other. That is, the optical unit 180 has a large efficiency of using the light from each of the LEDs that are used for achieving white light. Accordingly, a current which is required to obtain a luminance necessary as the optical unit 180, can be reduced.

Alternatively, an LED that emits magenta light may be mounted in the LED unit 172*a* and an LED that emits cyan light may be mounted in the LED unit 172*b*. Even by the light source 172 including such a combination of LED units, a light distribution pattern having white color can be formed. Alternatively, other than the aforementioned combinations of LEDs, the LED unit 172*b* may be configured to emit, as the light having a second color, light having a color that is in a complementary color relationship with the light having a first color emitted from the LED unit 172*a*. The complementary color relationship used herein can be strictly defined as a combination of colors that are exactly opposite in the color circle, but may be a combination of colors by which a color, which can be generally recognized as white color, can be achieved, without being limited to such a combination. For example, when white light is achieved by superimposing the aforementioned blue light and yellow light one on another, it can be said that the blue color and the yellow color are in a complementary color relationship. When white light is achieved by superimposing the aforementioned magenta light and cyan light one on another, it can also be said that the magenta color and the cyan color are in a complementary color relationship.

The optical unit 180 according to the present embodiment may further include a current adjusting unit 174 for adjusting a current flowing through at least one of the LED units 172*a* and 172*b*. The current adjusting unit 174 is configured to be able to adjust an amount of a current flowing through each of the LED units 172*a* and 172*b* and to be able to change the amount of a current in accordance with the rotation of the rotating reflector 26. The brightness (luminance) of each of the LEDs mounted in the LED units 172*a* and 172*b* is changed in accordance with the amount of a current.

Thus, in the optical unit 180, the color of a light distribution pattern can be changed by changing the ratio of currents flowing through the LED units 172*a* and 172*b*, respectively, with the current adjusting unit 174. Accordingly, the optical unit 180 can irradiate a target region with a light distribution pattern having a color suitable for an environment in which the lamp is used (weather, time, brightness, etc.) and the attribute of a driver (eyesight, age, etc.). In order to determine the use environment of a lamp, for example, a camera 176 provided for imaging an ambient environment can be used. The current adjusting unit 174 may include an operation unit for determining a highly-visible color of a light distribution pattern by processing the date (luminance data and RGB data) on the region imaged by the camera 176.

The optical unit 180 can also change the distributed light color of an arbitrary region in a light distribution pattern by periodically changing amounts of current flowing through the LED units 172*a* and 172*b*, respectively, with the current adjusting unit 174.

Figure 30:
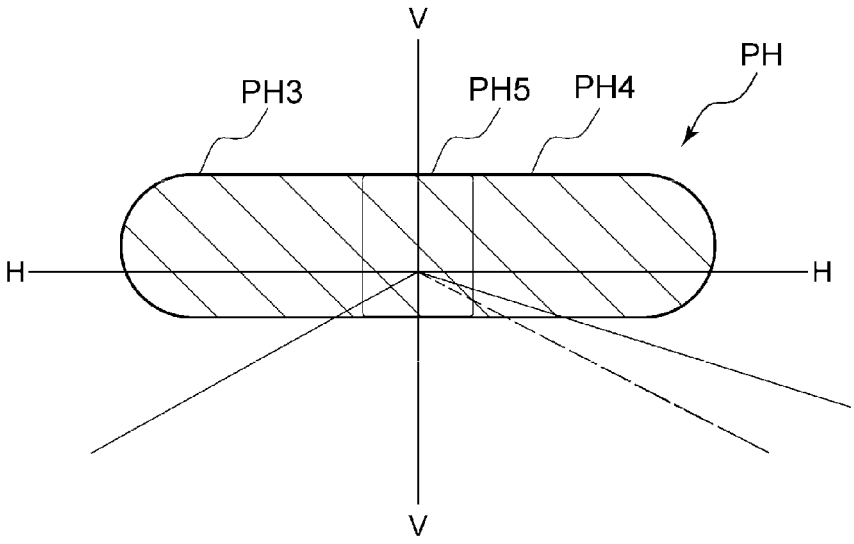
FIG. 30 is a schematic view for explaining a difference between distributed light colors in a light distribution pattern.

FIG. 30 is a schematic view for explaining a difference between distributed light colors in a light distribution pattern. For elderly drivers, there is the tendency that an object in peripheral vision can be further easily seen when irradiated with yellow light. In addition, a white line on a road can be further easily seen when irradiated with blue light. Accordingly, a light distribution pattern PH illustrated in FIG. 30 is preferred, in which regions PH3 and PH4 including the left and right periphery of a road are irradiated with yellowish light and the central region PH5 including a white line on the road is irradiated with bluish light.

In order to achieve such a light distribution pattern PH, a light source, having both the LED unit 172*a* in which an LED that emits blue light is mounted and the LED unit 172*b* in which an LED that emits yellow light is mounted, is preferred. The current adjusting unit 174 controls an amount of a current flowing through each of the LED units 172*a* and 172*b* such that, at a timing when the light emitted from the LED unit 172*b* is reflected by the rotating reflector 26 and the light irradiates the regions PH3 and PH4, an amount of a current flowing through the LED unit 172*b* becomes relatively large with respect to the LED unit 172*a*. Alternatively, the current adjusting unit 174 controls an amount of a current flowing through each of the LED units 172*a* and 172*b* such that, at a timing when the light emitted from the LED unit 172*a* is reflected by the rotating reflector 26 and the light irradiates the central region PH5, an amount of a current flowing through the LED unit 172*a* becomes relatively large with respect to the LED unit 172*b*. Thereby, the aforementioned light distribution pattern PH can be achieved.

Figure 31:
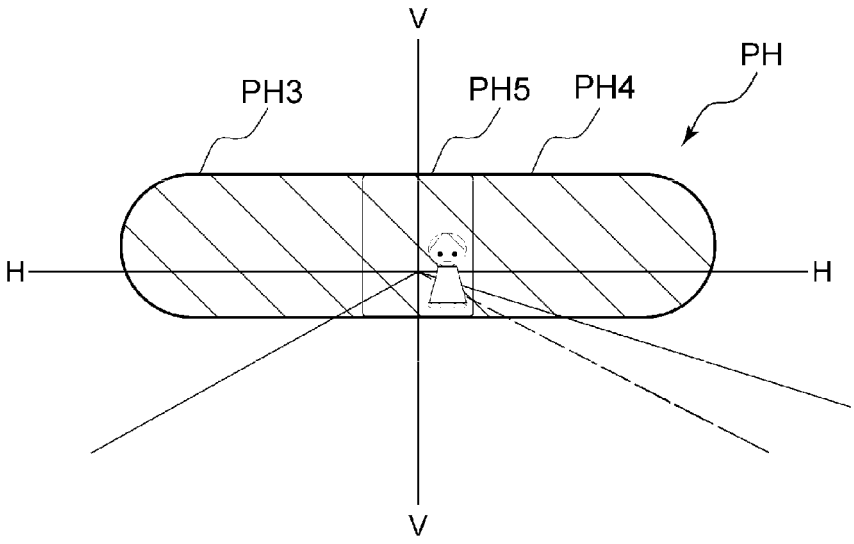
FIG. 31 is a schematic view for explaining a difference between distributed light colors in a light distribution pattern according to the variation.

FIG. 31 is a schematic view for explaining a difference between distributed light colors in a light distribution pattern according to the variation. As described above, the optical unit according to the present embodiment can change a distributed light color depending on a target, when the target is irradiated with the light emitted from the light source. For example, a target to be irradiated with light is a person, the target can be further easily seen by a driver, when irradiated with magenta light. Accordingly, the light distribution pattern PH illustrated in FIG. 31 is preferred, in which the regions PH3 and PH4 including the left and right periphery of a road are irradiated with normal white light and the central region PH5 including a region where the person is present is irradiated with magentaish light.

In order to achieve such a light distribution pattern PH, a light source, having both the LED unit 172*a* in which an LED that emits cyan light is mounted and the LED unit 172*b* in which an LED that emits magenta light is mounted, is preferred. The current adjusting unit 174 controls an amount of a current flowing through each of the LED units 172*a* and 172*b* such that, at a timing when the magenta light emitted from the LED unit 172*b* is reflected by the rotating reflector 26 and the light irradiates the central region PH5, an amount of a current flowing through the LED unit 172*b* becomes relatively large with respect to the LED unit 172*a*. Alternatively, the current adjusting unit 174 controls an amount of a current flowing through each of the LED units 172*a* and 172*b* such that, at a timing when the light emitted from the LED unit 172*a* is reflected by the rotating reflector 26 and the light irradiates the central region PH5, an amount of a current flowing through the LED unit 172*a* becomes relatively small with respect to the LED unit 172*b*. Thereby, the aforementioned light distribution pattern PH can be achieved.

Figure 32:
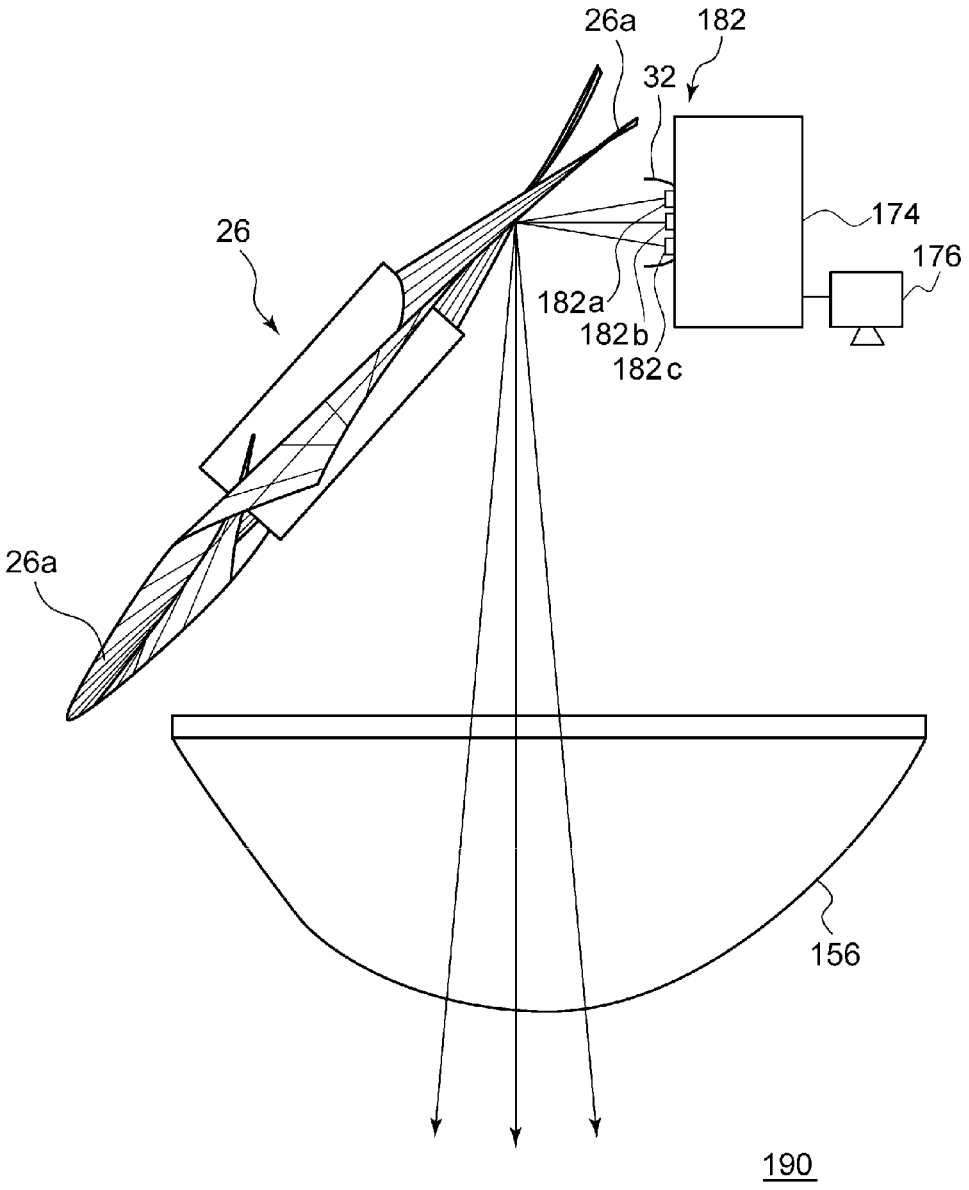
FIG. 32 is a top view schematically illustrating a configuration in which an optical unit according to a variation of Seventh Embodiment is included.

An optical unit, in which two types of LEDs having emitted light colors different from each other are used, has been described in the aforementioned embodiments; however, the types of LEDs to be combined together is not limited to two, but may be three or more. FIG. 32 is a top view schematically illustrating a configuration in which an optical unit according to a variation of Seventh Embodiment is included.

An optical unit 190 includes the rotating reflector 26 and a light source 182 having a plurality of types of LEDs that emit light different from each other. In the light source 182, a plurality of LED units 182*a*, 183*b*, and 182*c* are provided on the bottom of the CPC 32. The LED units 182*a*, 182*b*, and 182*c* are selected so as to emit light having colors different from each other. For example, an LED that emits red light may be mounted in the LED unit 182*a*, an LED that emits green light may be mounted in the LED unit 182*b*, and an LED that emits blue light may be mounted in the LED unit 182*c*. The optical unit 190 having such a combination of LEDs can achieve light distribution patterns having various colors including white by adjusting a current flowing through each LED unit with the current adjusting unit 174.

Further, the optical unit according to the present embodiment can form a light distribution pattern, in which a large range is irradiated, by scanning with the light from the LED units with the use of the rotating reflector 26, without a lot of LEDs being aligned. Furthermore, unevenness of the color or brightness in the light distribution pattern can be suppressed.

In a white light LED unit in which a blue light LED and a yellow phosphor is combined, not only brightness but also color is changed in most cases, when an amount of a current is changed. In the optical unit according to the present embodiment, however, a current, flowing through each of a plurality of types of LED units having emitted light colors different from each other, can be independently controlled. Accordingly, even with an LED, the brightness or the color of which is out of standards before, a light distribution patter having a desired color can be achieved by controlling an amount of a current in each LED unit. That is, the standard range of a usable LED can be widened, and hence the procurement cost of LEDs and the loss cost due to out-of standard LEDs can be reduced.

The present invention has been described above with reference to the aforementioned respective embodiments, but the invention is not limited to the aforementioned respective embodiments, and variations in which each component of the embodiments is appropriately combined or substituted are also encompassed by the invention. In addition, appropriate changes of the combinations or the orders of the processes in the aforementioned embodiments can be made and various modifications, such as design modifications, can be made with respect to the aforementioned embodiments, based on the knowledge of those skilled in the art, and embodiments in which such modifications are made can also be encompassed by the present invention.

For example, in the automotive headlamp 10 according to the aforementioned embodiments, three blades in the rotating reflector 26 may be colored in red, green, and blue such that white irradiation light is formed by mixing the colors. In this case, the color of the irradiation light can be changed by controlling the ratio of a time during which the light from the LED 28 is reflected by each of the blades having surface colors different from each other. The surface of the blade can be colored by forming a top coat layer with, for example, deposition.

Furthermore, in the automotive headlamp 10, a spot light having a very high maximum light intensity can be formed at a desired position by stopping the rotating reflector 26 an an arbitrary angle, without rotating the rotating reflector 26. Thereby, it becomes possible to attract the attention of a driver by irradiating a specific obstacle (including a person) with bright spot light.

Figure 33:
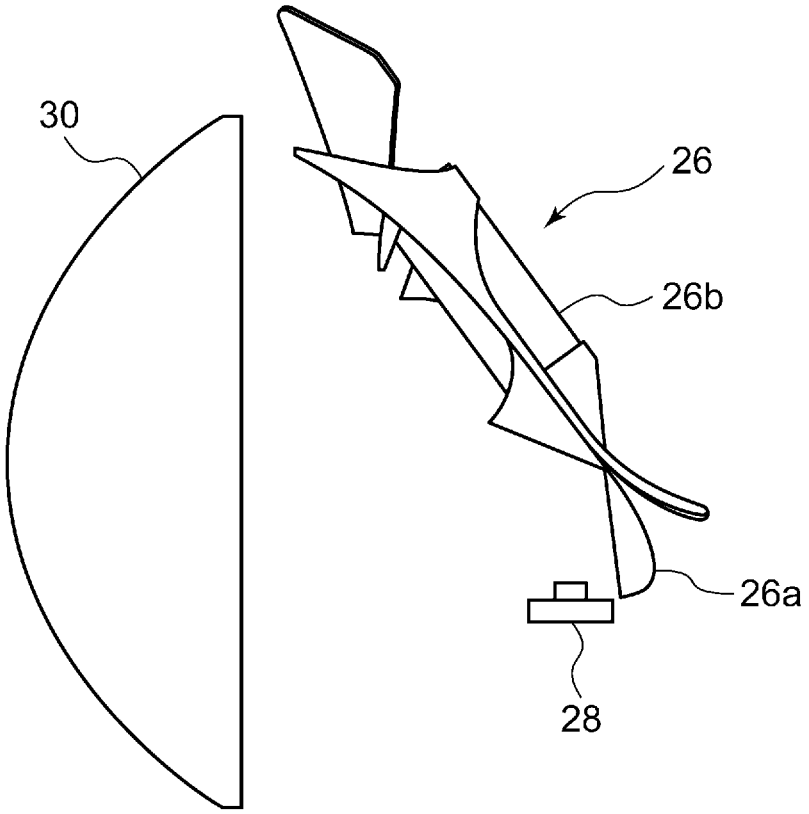
FIG. 33 is a view illustrating arrangement of a rotating reflector according to the variation.

In the lamp unit 20 illustrated in the FIG. 1, the rotating reflector 26 is arranged such that the light from the LED 28 is reflected by the blade nearer to the convex lens 30 than to the rotating part 26*b*. FIG. 33 is a view illustrating arrangement of a rotating reflector according to the variation. As illustrated in FIG. 33, the rotating reflector 26 according to the variation is arranged such that the light from the LED 28 is reflected by the blade farther from the convex lens 30 than from the rotating part 26*b*. Accordingly, the rotating reflector 26 can be arranged further near to the convex lens 30 as illustrated in FIG. 33, and hence the depth (vehicle longitudinal direction) of the lamp unit can be made compact.

Herein, the aspheric lens to be used in the aforementioned embodiments is not necessarily required to have a function of correcting a distorted image, and may be one not correcting a distorted image.

The case where the optical unit is applied to an automotive headlamp has been describe in the aforementioned embodiments; however, the application of the optical unit is not limited to this field. The optical unit may be applied, for example, to lighting devices on stages or in recreational facilities where lighting is performed by switching various light distribution patterns one to another. A lighting device to be used in these fields is required to have a large-scale mechanism before; however, when an optical unit according to the present embodiment is used, a large-scale mechanism is not required and the lighting device can be miniaturized, because various light distribution patterns can be formed by the rotation of a rotating reflector and turning on/off of a light source.

Herein, in the optical unit according to the aforementioned Sixth Embodiment, a plurality of light sources are arranged in the vehicle longitudinal direction, but the light sources may be arranged in the vertical direction of the optical axis. Thereby, a region can also be scanned in the up-down direction with the light from the light source.

What is claimed is:

1. An optical unit comprising:

a light source including both a first light emitting element for emitting light having a first color and a second light emitting element for emitting light having a second color that is different from the first color;

a rotating reflector configured to be rotated in one direction around a rotational shaft defining a rotational axis, while reflecting the light having the first color and the light having the second color, which have been emitted from the light source; and a projection lens arranged ahead of the rotating reflector, wherein the rotating reflector includes:

a rotating part; and a plurality of blades provided around the rotating part and functioning as a reflecting surface, each of the plurality of blades having a twisted shape in which an angle between an optical axis and the reflecting surface is changed moving toward a circumferential direction around the rotational axis and being configured to project a scanning irradiation beam by passing in front of at least one of the first light emitting element and the second light emitting element, and in the rotating reflector, the reflecting surface is provided such that a predetermined light distribution pattern is formed with the light having the first color and the light having the second color, which have been reflected by the rotation of the rotating reflector, being superimposed one on another.

2. The optical unit according to claim 1, wherein the second light emitting element emits, as the light having the second color, light having a color that is in a complementary color relationship with the light having the first color.

3. The optical unit according to claim 1 further comprising:

a current adjusting unit configured to adjust a current flowing through at least one of the first light emitting element and the second light emitting element.

4. The optical unit according to claim 1, wherein the rotating reflector is configured to cause a light source virtual image formed by light reflected by the rotating reflector to be moved near a focal point of the projection lens.

5. The optical unit according to claim 4, wherein a projected image is moved for scanning in a horizontal direction by the rotation of the rotating reflector.

6. The optical unit according to claim 1, wherein the light source includes a first light source and a second light source, and the first light source includes the first light emitting element and the second light emitting element;

the first light source and the second light source are arranged such that a position at which light emitted by the first light source is reflected by one of the plurality of blades is different from a position at which light emitted by the second light source is reflected by the one of the plurality of blades.

7. The optical unit according to claim 1, wherein the optical unit is capable of changing a distributed light color of an arbitrary region in a light distribution pattern by periodically changing amounts of current flowing through the light source.

8. An optical unit comprising:

a light source including a first light emitting element for emitting light having a first color, a second light emitting element for emitting light having a second color different from the first color, and a third light emitting element for emitting light having a third color different from the first color and the second color;

a rotating reflector configured to be rotated in one direction around a rotational shaft defining a rotational axis, while reflecting the light having the first color, the light having the second color, and the light having the third color; and a projection lens arranged ahead of the rotating reflector, wherein the rotating reflector includes:

a rotating part; and a plurality of blades provided around the rotating part and functioning as a reflecting surface, each of the plurality of blades having a twisted shape in which an angle between an optical axis and the reflecting surface is changed moving toward a circumferential direction around the rotational axis and being configured to project a scanning irradiation beam by passing in front of at least one of the first light emitting element, the second light emitting element, and the third light emitting element, and in the rotating reflector, the reflecting surface is provided such that a predetermined light distribution pattern having white color is formed with the light having the first color, the light having the second color, and the light having the third color, which have been reflected by the rotation of the rotating reflector, being superimposed one on another at the projection lens.

9. The optical unit according to claim 8 further comprising:

a current adjusting unit configured to adjust a current flowing through at least one of the first light emitting element, the second light emitting element, and the third light emitting element.

10. An automotive headlamp provided with the optical unit of claim 1.

* * * * *